US007109662B2

(12) United States Patent
Sakita

(10) Patent No.: US 7,109,662 B2
(45) Date of Patent: Sep. 19, 2006

(54) METHOD FOR DRIVING PLASMA DISPLAY PANEL

(75) Inventor: Koichi Sakita, Akashi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/634,830

(22) Filed: Aug. 6, 2003

(65) Prior Publication Data

US 2004/0046509 A1 Mar. 11, 2004

(30) Foreign Application Priority Data

Aug. 13, 2002 (JP) ..... 2002-235596

(51) Int. Cl.
*G09G 3/10* (2006.01)
*G09G 3/28* (2006.01)

(52) U.S. Cl. ..... 315/169.3; 345/67

(58) Field of Classification Search ..... 315/169.3, 315/169.4; 345/55, 60, 63, 82, 84, 208, 67, 345/76

See application file for complete search history.

(56) References Cited

U.S. PATENT DOCUMENTS

| | | | | |
|---|---|---|---|---|
| 5,745,086 | A | 4/1998 | Weber | 345/63 |
| 6,476,561 | B1 * | 11/2002 | Okada | 315/169.1 |
| 6,545,423 | B1 * | 4/2003 | Sakita et al. | 315/169.3 |
| 6,633,285 | B1 * | 10/2003 | Kigo et al. | 345/204 |
| 6,653,795 | B1 * | 11/2003 | Kang et al. | 315/169.3 |
| 6,670,774 | B1 * | 12/2003 | Son et al. | 315/169.4 |
| 6,724,357 | B1 * | 4/2004 | Kim et al. | 345/60 |
| 6,738,033 | B1 * | 5/2004 | Hibino et al. | 345/60 |
| 6,844,685 | B1 * | 1/2005 | Lee | 315/169.3 |
| 6,867,552 | B1 * | 3/2005 | Takamori et al. | 345/67 |
| 2001/0019246 | A1 | 9/2001 | Koichi et al. | 315/169.3 |
| 2003/0006945 | A1 * | 1/2003 | Lim et al. | 345/67 |

FOREIGN PATENT DOCUMENTS

| | | |
|---|---|---|
| CN | 1254153 A | 5/2000 |
| EP | 1 065 646 | 1/2001 |

OTHER PUBLICATIONS

Sakita, Koichi, et al., "Ramp Setup Design Technique in Three-electrode Surface-discharge AC-PDPs", *SID International Symposium Digest of Technical Papers*, vol. XXXIII, No. II, pp. 948-950.

(Continued)

*Primary Examiner*—Thuy V. Tran
*Assistant Examiner*—Minh Dieu A
(74) *Attorney, Agent, or Firm*—Staas & Halsey LLP

(57) ABSTRACT

A method of driving a PDP including alternately-arranged X and Y electrodes and A electrodes crossing the X and Y electrodes provides a recurring cycle of a resetting period, an addressing period, and a sustaining period. The method includes applying a ramp waveform in the resetting period. Discharge starting threshold voltages between the X and Y electrodes and between the A and Y electrodes are denoted by $V_{tXY}$ and $V_{tAY}$, respectively. Voltages applied between the X and Y electrodes and between the A and Y electrodes at the trailing edge of the ramp waveform are denoted by $V_{XY}$ and $V_{AY}$, respectively. An offset voltage of the voltage applied between the A and Y electrodes at the end of the sustaining period is denoted by $V_{aoff}$. In such a case, the voltage of a driving waveform for each electrode is set so as to satisfy the relational expression "$2V_{tAY}-V_{tXY}>2V_{AY}-V_{XY}-2V_{aoff}$".

5 Claims, 25 Drawing Sheets

$P_{WV}$: Post-Resetting Wall Voltage Point
(Point of Wall Voltage in the Cell turned OFF)

OTHER PUBLICATIONS

Partial European Search Report dated May 23, 2006 of Application No. 03 01 6639.

Kim et al., "The Addressing Characteristics of An Alternating Current Plasma Display Panel Adopting a Ramping Reset Pulse," IEEE Transactions on Electron Devices, IEEE Service Center, vol. 48, No. 8, Aug. 2001, pp. 1556-1563.

* cited by examiner

Conditional Expression: $2V_{tAY}' - V_{tXY} \leqq V_{YR} - V_{XR} + V_S$

Conditional Expression: $2V_{tAY} - V_{tXY} \leqq V_{YR} - V_{XR} + V_{S2}$

Conditional Expression: $2V_{tAY} - V_{tXY} \leqq V_{YR} - V_{XR} + 2V_A$

Conditional Expression: $2V_{tAY} - V_{tXY} \leqq V_{YR} - V_{XR} + V_S + 2V_A$

Conditional Expression: $2V_{tAY} - V_{tXY} \leqq V_{YR} - V_{XR} + V_S$

Conditional Expression: $2V_{tAY} - V_{tXY} \leqq V_{YR} - V_{XR} + 2V_A$

Conditional Expression: $2V_{tAY} - V_{tXY} \leqq V_{YR} - V_{XR} + V_S + 2V_A$

Conditional Expression: $2V_{tAY} - V_{tXY} \leqq 2V_{AR} + V_{YR} - V_{XR}$

METHOD FOR DRIVING PLASMA DISPLAY PANEL

BACKGROUND OF THE INVENTION

1. Field of the Invention

The present invention relates to methods for driving plasma display panels, and more particularly relates to the improvement of a driving method for resetting.

2. Description of the Related Art

FIG. 1 shows the structure of a plasma display panel (hereinafter referred to as a PDP).

The PDP is manufactured by attaching a front base plate 10 and a rear base plate 20 to each other. The front base plate 10 includes a plurality of pairs of display electrodes (X electrodes 11 and Y electrodes 12). A dielectric layer 13 covers these electrodes, and a protective film-14 made of MgO or the like covers the dielectric layer 13.

A plurality of address electrodes (A electrodes 21) is arranged on the rear base plate 20. A dielectric layer 23 covers the A electrodes 21. Barrier ribs 25 partitioning discharge spaces into regions are disposed between the adjacent A electrodes 21. Each of the regions is applied with one of red, green, and blue fluorescent materials 26R, 26G, and 26B.

The front base plate 10 and the rear base plate 20 are attached to each other so that the A electrodes 21 intersect the X electrodes 11 and the Y electrodes 12. One cell is arranged at the intersection of each of the A electrodes 21 and each pair of the X electrodes 11 and the Y electrodes 12. One pixel of the PDP is formed of three adjacent cells colored red, green, and blue.

Referring to FIG. 2, a method for driving the PDP to perform display will now be described. The PDP performs grayscale display by dividing one field into a plurality of sub-fields having different light emitting periods. FIG. 2 illustrates $2^8$ gray-level control (that is, 256 gray levels ($2^8$=256)). One sub-field (hereinafter referred to as SF) consists of a resetting period, an addressing period, and a sustaining period (light-emitting period).

The light-emitting periods in the SFs are arranged to derive a ratio of 1:2:4:8:16:32:64:128 or a ratio close to this ratio. For example, the gray-level 10 is displayed by turning ON a cell in SF2 that has an weight of 2 and SF4 that has an weight of 8 and turning OFF the cell in the remaining SFs.

The operation of the PDP during one SF will now be described. As described above, one SF consists of the resetting period, addressing period, and sustaining period. In the resetting period, the charge states (wall charges) of all cells are set to a predetermined state. In the addressing period, a selective writing discharge or erasing discharge is initiated in each desired cell to be displayed. The charge state of each cell is changed by the selective writing discharge or erasing discharge. In the sustaining period, a sustaining discharge by a sustaining pulse is caused only in the cell whose charge state has been changed.

FIG. 3 shows voltage waveforms applied to the electrodes. In a period excluding the addressing period during which driving waveforms are selectively applied to an A electrode group and a Y electrode group, that is, in the resetting period and the sustaining period, the common waveforms are applied to the corresponding electrode groups. In contrast, in the addressing period, data pulses (also referred to as address pulses) A(1) to A(n) in accordance with display data are applied to the individual A electrodes 21, and scan pulses ScP1 to ScPn that are separated in the time domain to perform line selection are applied to the individual Y electrodes 12. In the resetting period, a gradually increasing voltage waveform (positive ramp wave) RPa and a gradually decreasing voltage waveform (negative ramp wave) RPb are applied to the Y electrodes 12.

FIG. 4 shows the basic resetting operation. A resetting waveform used here is a waveform combining the positive ramp wave and the negative ramp wave. In order to simply describe the principle, the resetting operation between two electrodes, that is, an α electrode and β electrode, will now be described. The α electrode and the β electrode described here refer to two electrodes of the X electrode, Y electrode, and A electrode. The phrase "voltage applied between the α and β electrodes (or α-β applied voltage)" refers to a voltage applied between the α electrode and the β electrode (difference (voltage) between the electrodes), and, more specifically, refers to a potential (relative value) of the α electrode on the basis of the β electrode (the same applies to the following description). One of the XY voltage waveform and the AY voltage waveform in the resetting period shown in FIG. 3 serving as α-β voltage waveform corresponds to the waveform shown in FIG. 4.

Referring to FIG. 4, first, a negative ramp wave having an amplitude of $-V_{R1}$ (positive or negative is indicated by the sign of the amplitude) is applied between the α and β electrodes, which is followed by application of a positive ramp wave with an amplitude of $V_{R2}$. The solid line represents the voltage applied between the electrodes. The dotted line, broken line, and dotted-chain line represent the sign-inverted voltages (wall voltages) representing the charge state of a cell. Resetting refers to setting the states of cells to the same state regardless of their previous states (turned-ON or turned-OFF states). Discussion of the resetting operation requires investigation of each cell's state at the time the previous SF has ended. A wall voltage of a cell that has been turned ON in the previous SF (referred to as a wall voltage of a "turned-ON cell") is represented by the broken line. A wall voltage of a cell that has been turned OFF in the previous SF (referred to as a wall voltage of a "turned-OFF cell") is represented by the dotted line.

Since a voltage component (wall voltage) due to the charging by the wall charge is added to an applied voltage component, the effective voltage required by each cell's discharge space (hereinafter refereed to as the "cell voltage") is:

cell voltage=applied voltage+wall voltage.

Since the sign of the wall voltage is inverted, the cell voltage in FIG. 4 corresponds to the length between the dotted line (or the broken line or the dotted-chain line) and the solid line (the same applies to the following description). The cell voltage is positive when the solid line is above the dotted line (or the broken line or the dotted-chain line), whereas the cell voltage is negative when the solid line is below the dotted line (or the broken line or the dotted-chain line). For example, in FIG. 4, the cell voltage upon application of the negative ramp wave in the first half is negative, whereas the cell voltage upon application of the positive ramp wave in the second half is positive.

Prior to the start of resetting (time to), the wall voltages of both the turned-ON cell and turned-OFF cell are negative (since the sign is inverted, the dotted line and broken line above 0 V represent negative wall voltages). The turned-ON cell is more strongly negatively charged. Negative voltages are gradually applied to the two cells, and the absolute values of the negative cell voltages are increased. Since the turned-ON cell is more strongly negatively charged, the turned-ON cell is discharged at time $t_1$ before the non-turned-ON cell is discharged. At time $t_1$, a waveform representing the discharge (light) in the turned-ON cell rises, as shown in FIG. 4. Once the discharge has started, the wall voltage is accumulated so that the cell voltage is maintained at a discharge starting threshold voltage $-V_{t1}$ (positive or negative is indicated by the sign of the discharge starting threshold voltage) having the α electrode as the cathode (hereinafter this is written as "the wall voltage is 'written' so that the cell voltage is maintained at the discharge starting threshold voltage). Slightly after the discharge in the turned-ON cell, the turned-OFF cell starts discharging at time $t_2$. At time $t_2$, a waveform representing the discharge (light) in the turned-OFF cell rises, as shown in FIG. 4. Once the discharge has started, the wall voltage of the same value is written so that the cell voltage of the turned-OFF cell is maintained at the discharge starting threshold voltage $-V_{t1}$ having the α electrode as the cathode. The wall voltage in this case is represented by the dotted-chain line. Subsequently, when the falling of the negative ramp wave stops (maximum voltage) at time $t_a$, the waveform representing the discharge (light) decreases to level 0. At time $t_3$, the negative ramp wave ends. At this time, the wall voltages of both the turned-ON cell and the turned-OFF cell are set to the same voltage $-V_{R1}+V_{t1}$.

The polarity of the applied voltage is inverted. This time, a positive ramp wave is applied. Since the wall voltages of both the turned-ON cell and the turned-OFF cell have been set to the same value at time $t_3$, the two cells simultaneously starts discharging at time $t_4$. Subsequently, the discharges are sustained, and the wall voltages are written while the cell voltages are maintained at a discharge starting threshold voltage $V_{t2}$, Waveforms representing the discharges (light) in both the turned-ON cell and the turned-OFF cell rise at time $t_4$ and decrease to level 0 at time $t_b$ at which the rising of the positive ramp wave stops. Each of the wall voltages at time $t_5$ at which the positive ramp wave ends is $V_{R2}-V_{t2}$.

Since the discharge starting threshold voltage $V_{t2}$ is a constant peculiar to a discharge between two electrodes, the wall voltage after the positive ramp wave has ended is determined only by the applied voltage amplitude $V_{R2}$.

Using the basic principle of the resetting described above, turned-ON cells and turned-OFF cells are reset. In order to describe the principle, the relationship between two electrodes (that is, between α and β electrodes) has been described. Since practical PDP cells each have three types of electrodes consisting of the X electrode, Y electrode, and A electrode, the operation is more complicated.

FIG. 5A shows the resetting waveform portions shown in FIG. 3. Each resetting waveform consists of two steps, namely, a first step and a second step. The potential of the address electrode is fixed to a zero potential during the resetting period. To the X electrode, a negative pulse (constant voltage pulse having an amplitude of $-V_{X1}$) is applied in the first step and a positive pulse (constant voltage pulse having an amplitude of $V_{X2}$) is applied in the second step. To the Y electrode, a gradually increasing voltage waveform having an amplitude of $V_{Y1}$ (positive ramp wave) is applied in the first step and a gradually decreasing voltage waveform having an amplitude of $-V_{Y2}$ (negative ramp wave) is applied in the second step.

In order to initiate a discharge between each two electrodes of the three electrodes (X electrode, Y electrode, and A electrode) of the PDP, it is convenient to use two types of "voltages between two electrodes", that is, between the X and Y electrodes and between the A and Y electrodes, as shown in FIG. 5B. The two types of voltages are voltages between two electrodes on the basis of the Y electrode (that is, the electrode represented by the latter character of a character string representing the two electrodes).

In the first step, a gradually decreasing voltage waveform having an amplitude of $-(V_{X1}+V_{Y1})$ is applied between the X and Y electrodes, and a gradually decreasing voltage waveform having an amplitude of $-V_{Y1}$ is applied between the A and Y electrodes. In the second step, a gradually increasing voltage waveform having an amplitude of $V_{X2}+V_{Y2}$ is applied between the X and Y electrodes, and a gradually increasing voltage waveform having an amplitude of $V_{Y2}$ is applied between the A and Y electrodes.

Referring to FIG. 5B, wall voltages are represented by the dotted lines and plotted while the signs thereof are inverted (the same applies to the following description). There are two types of wall voltages of the PDP having three types of electrodes: a wall voltage between the X and Y electrodes and a wall voltage between the A and Y electrodes.

A cell voltage between the X and Y electrodes is referred to as an XY cell voltage; a voltage applied between the X and Y electrodes is referred to as an XY applied voltage; and a wall voltage between the X and Y electrodes is referred to as an XY wall voltage. Similarly, a cell voltage between the A and Y electrodes is referred to as an AY cell voltage; a voltage applied between the A and Y electrodes is referred to as an AY applied voltage; and a wall voltage between the A and Y electrodes is referred to as an AY wall voltage (the same applies to the following description).

An effective voltage required by each cell's discharge space (cell voltage) is the sum of an applied voltage and a wall voltage:

XY cell voltage=XY applied voltage+XY wall voltage

AY cell voltage=AY applied voltage+AY wall voltage

Since the sign of each of the plotted wall voltages is inverted in FIG. 5B, the cell voltage refers to the distance between the dotted line and the solid line. When the solid line is above the dotted line, the cell voltage is positive. When the solid line is below the dotted line, the cell voltage is negative.

Since the PDP has three types of electrodes, there are discharge starting threshold voltages between the X and Y and between the Y and X electrodes, between the A and Y and between the Y and A electrodes, and between the A and X and between the X and A electrodes. Specifically, there are six types:

$V_{tXY}$: discharge starting threshold voltage between X and Y electrodes having Y electrode as cathode (hereinafter referred to as an XY discharge starting threshold voltage);

$V_{tYX}$: discharge starting threshold voltage between Y and X electrodes having X electrode as cathode (hereinafter referred to as a YX discharge starting threshold voltage);

$V_{tAY}$: discharge starting threshold voltage between A and Y electrodes having Y electrode as cathode (hereinafter referred to as an AY discharge starting threshold voltage);

$V_{tYA}$: discharge starting threshold voltage between Y and A electrodes having A electrode as cathode (hereinafter referred to as a YA discharge starting threshold voltage);

$V_{tAX}$: discharge starting threshold voltage between A and X electrodes having X electrode as cathode (hereinafter referred to as an AX discharge starting threshold voltage); and $V_{tXA}$: discharge starting threshold voltage between X and A electrodes having A electrode as cathode (hereinafter referred to as an XA discharge starting threshold voltage).

FIG. 6 shows an example of normal resetting. The broken line represents a wall voltage of a cell that has been turned ON in an SF immediately before the start of resetting (hereinafter referred to as a previous SF), and the dotted-chain line represents a wall voltage of a cell that has been turned OFF in the previous SF. In the case of the turned-ON cell, the XY wall voltage immediately before the start of the resetting is negative (please note that the sign is inverted), and the AY wall voltage is zero. In contrast, in the case of the turned-OFF cell, both the XY wall voltage and the AY wall voltage immediately before the start of the resetting are positive (please note that the sign is inverted).

The "turned-ON cell" that has been turned ON in the previous SF will now be described. At time (1), the XY cell voltage exceeds the YX discharge starting threshold voltage $-V_{tYX}$, and a discharge is initiated in the "turned-ON cell". Subsequently, the wall voltage is written so that the XY cell voltage is maintained at $-V_{tYX}$ until the amplitude of the XY applied voltage becomes $-V_{xY1}$ and the amplitude of the AY applied voltage becomes $-V_{AY1}$. At the same time, the AY wall voltage changes. Since the change in the AY wall voltage is smaller than the change in the AY applied voltage, the absolute value of the AY cell voltage gradually increases. In this example, the AY cell voltage does not exceed the AY discharge starting threshold voltage in the first step, and no discharge is thus initiated. Therefore, the AY cell voltage is not set to a uniform value. At the first step end time (3), only the XY wall voltage is set, whereas the AY wall voltage remains unset.

In the second step, the XY applied voltage and the AY applied voltage increase, and the XY cell voltage and the AY cell voltage increase. At time (4), the XY cell voltage exceeds the XY discharge starting threshold voltage $V_{tXY}$, and a discharge is initiated. Subsequent to time (4), the XY wall voltage is written so that the XY cell voltage is maintained at $V_{tXY}$. At the same time, the AY wall voltage is written. Since the change in the AY wall voltage is smaller than the change in the AY applied voltage, the absolute value of the AY cell voltage gradually increases. At time (5), the AY cell voltage exceeds the AY discharge starting threshold voltage $V_{tAY}$, and a discharge is initiated. The AY wall voltage is written so that the AY cell voltage becomes the constant value $V_{tAY}$. At the resetting end time (7), both the XY wall voltage and the AY wall voltage are set.

The "turned-OFF cell" that has been turned OFF in the previous SF will now be described. In the first step, at time (2), the XY cell voltage exceeds the XY discharge starting threshold voltage $-V_{tXY}$, and a discharge is initiated. Subsequently, the XY wall voltage is written so that the XY cell voltage is maintained at $-V_{tYX}$ until the XY applied voltage in the first step becomes $-V_{xY1}$ and the AY applied voltage becomes $-V_{AY1}$. At the same time, the AY wall voltage changes. Since the change in the AY wall voltage is smaller than the change in the AY applied voltage, the AY cell voltage gradually increases. In this example, no discharge is initiated since the AY cell voltage does not exceed the AY discharge starting threshold voltage. Thus, the AY cell voltage is not set to the uniform value. At the first step end time (3), only the XY wall voltage is set, whereas the AY wall voltage remains unset.

The operation in the second step will now be described. The XY applied voltage and the AY applied voltage increase, and the XY cell voltage and the AY cell voltage increase. At time (4), the XY cell voltage first exceeds the XY discharge starting threshold voltage $V_{tXY}$, and a discharge is initiated. Subsequent to time (4), the XY wall voltage is written so that the XY cell voltage is maintained at $V_{tXY}$. At the same time, the AY wall voltage changes. Since the change in the AY wall voltage is smaller than the AY applied voltage, the AY cell voltage gradually increases. At time (6), the AY cell voltage exceeds the AY discharge starting threshold voltage $V_{tAY}$, and a discharge is initiated. The AY wall voltage is written so that the AY cell voltage becomes the constant value $V_{tAY}$. At the second step end time (7), both the XY wall voltage and the AY wall voltage are set.

As described above, in this example, regardless of the ON/OFF state in the previous SF, the XY wall voltages and the AY wall voltages in the cases of the turned-ON cell and the turned-OFF cell are set to the same values, respectively, at the end of the resetting.

What is important in the resetting using the ramp waves is that the cell must be driven so that two simultaneous discharges, that is, a discharge between the X and Y electrodes having the Y electrode as the cathode (hereinafter referred to as an XY discharge) and a discharge between the A and Y electrodes having the Y electrode as the cathode (hereinafter referred to as an AY discharge), are simultaneously initiated immediately before the end of the resetting. On the other hand, the ramp waves in the first step need not initiate two discharges at the same time.

The operation described above is geometrically analyzed using a "cell voltage plane" and a "discharge starting threshold voltage closed curve", which are presented at an international conference of the Society for Information Display in 2001 (see "High-speed Address Driving Waveform Analysis Using Wall Voltage Transfer Function for Three Terminals and Vt Close Curve in Three-Electrode Surface-Discharge AC-PDPs", pp. 1022 to 1025, SID 01 DIGEST, 2001).

Referring to FIGS. 7A and 7B, the "cell voltage plane" and "discharge starting threshold voltage closed curve" will now be described. (The contents related to FIGS. 7A and 7B are disclosed in Japanese Unexamined Patent Application Publication No. 2001-242825.)

Since the cell voltages, wall voltages, and applied voltages come in pairs of the X and Y electrodes and the A and Y electrodes, they are represented as two-dimensional voltage vectors, namely, a cell voltage vector ($V_{CXY}$, $V_{CAY}$), a wall voltage vector ($V_{WXY}$, $V_{WAY}$), and an applied voltage vector ($V_{aXY}$, $V_{aAY}$).

A coordinate plane, which is referred to as the "cell voltage plane," having the XY cell voltage $V_{CXY}$ as the abscissa and the AY cell voltage $V_{CAY}$ as the ordinate is defined. The relationships among the three vectors are visually represented in this plane using points and arrows.

FIG. 7A shows the "cell voltage plane" and the relationship among the three voltage vectors.

Since the discharge starting threshold voltages play an important role in the resetting operation, points of the discharge starting threshold voltages are plotted in the "cell voltage plane". These points constitute a "discharge starting threshold voltage closed curve" (hereinafter referred to as a "$V_t$ closed curve").

FIG. 7B shows a measured $V_t$ closed curve. Although the XY discharge starting threshold voltage portion does not constitute a line but constitutes a slightly distorted shape, the "$V_t$ closed curve" has a shape relatively similar to a hexagon. The following description assumes that the "$V_t$ closed curve" has a hexagonal shape. The vertices of the hexagon simultaneously satisfy two discharge starting threshold voltages and play an important role in the resetting operation. Since two discharges are initiated at the six vertices, the six vertices are referred to as "simultaneous discharge points".

Referring to FIGS. 8A and 8B, a method of determining, from the "cell voltage plane" and "$V_t$ closed curve", the wall voltage vector that changes in accordance with a discharge upon application of a ramp wave is described.

The wall voltage state prior to application of a ramp wave is at point 0 in FIG. 8A. Upon application of the ramp wave, the cell voltage changes toward point 1 and exceeds the XY discharge starting threshold voltage $V_{tXY}$. When a discharge is caused by the ramp wave (ramp-caused discharge), once the cell voltage has exceeded the threshold, the wall voltage is written so that the cell voltage is maintained at the threshold. In other words, referring to FIG. 8A, a wall voltage vector 11' (vector connecting point 1 and point 1') (and so forth) is written. The discharge is sustained until the absolute value of the ramp wave voltage reaches its maximum. While the XY cell voltage is maintained at around the XY discharge starting threshold voltage $V_{tXY}$, the AY cell voltage increases. In other words, the cell voltage point changes in a sequence of 1, 1', 2, 2', 3, 3', . . . , 5, 5' shown in FIG. 8A. A micro-increase in the applied voltage is represented by the solid arrow, and a micro-increase in the wall voltage is represented by the dotted arrow. The micro-increase in the wall voltage will now be described.

Since the XY discharge has been initiated, the charge mainly moves between the X electrode and the Y electrode. When a wall charge of +Q moves to the X electrode and a wall charge of −Q moves to the Y electrode, a wall charge of +Q−(−Q)=2Q moves between the X and Y electrodes, and a wall charge of 0−(−Q)=Q moves between the A and Y electrodes. In the plane having $V_{CXY}$ and $V_{CAY}$ as the coordinate axes, the direction written by the XY discharge has a slope of ½. More accurately speaking, the slope needs to be determined not from the wall charge, but from the wall voltage. The slope depends on the forms and materials of the dielectric layers covering the electrodes of the PDP. The slope is roughly near ½.

The wall voltage vector to be written until the end of the ramp wave is determined as in FIG. 8B. FIG. 8B shows a vector connecting the start point and end point of each applied voltage vector representing the micro-change and a vector connecting the start point and end point of each wall voltage vector representing the micro-change. That is, vector 05 is a total applied voltage vector, and vector 55' is a total written wall voltage vector.

Point 5 is determined by adding the total applied voltage vector to the initial wall voltage point 0. A line that passes through point 5 and that has a slope of ½ is written. The intersection 5' of the written line and the "$V_t$ closed curve" is the changed cell voltage point. Vector 55' is the total written wall voltage. As discussed above, the total wall voltage vector that has been written by the ramp wave and the cell voltage point are determined from the geometric relationship.

In the above description, the cell voltage point is determined from the geometric relationship. The cell voltage is not increased to a very large value, such as point 5 of FIG. 8B. Actually, the cell voltage point moves in the vicinity of the "$V_t$ closed curve", such as point 5 of FIG. 8A.

The AX discharge and the AY discharge can be analyzed in a similar manner. FIG. 9 shows wall voltage vectors written when the XY discharge, AY discharge, AX discharge, and the like are initiated. Each white dot represents an initial wall voltage. Each solid arrow represents an applied voltage vector. Each dotted arrow represents a wall voltage vector written by a ramp-caused discharge. Each black dot represents a wall voltage point subsequent to the end of the ramp wave. During the XY discharge, a wall voltage vector having a slope of ½ is written. During the AY discharge, a wall voltage vector having a slope of 2 is written. During the AX discharge, a wall voltage vector having a slope of −1 is written. Although these slopes depend on the forms and materials of the dielectric layers covering the electrodes of the PDP, each of the slopes has an approximately equal value.

FIGS. 10A and 10B show the analysis of the operation shown in FIG. 6. Specifically, FIG. 10A shows the operation analysis of the turned-ON cell, and FIG. 10B shows the operation analysis of the turned-OFF cell.

The turned-ON cell in FIG. 10A is at point A prior to resetting. Referring to the waveform shown in FIG. 6, at first the applied voltage changes step-wisely, and the cell voltage point moves to point B. Next, a discharge is initiated at point C upon application of the negative ramp wave, and the writing of the wall voltage starts. Since the discharge is the XY discharge, the writing direction has a slope of ½. The cell voltage is at point E at the end of the first ramp wave. In transition from the first ramp wave to the second ramp wave, the applied voltage suddenly changes, and the cell voltage point moves to point F. Upon application of the second ramp wave, a discharge is initiated at point G, and the writing of the wall voltage starts. Since the discharge is the XY discharge, at first the wall voltage is written with a slope of ½. Subsequent to the start of the discharge, the cell voltage point moves upward along the "$V_t$ closed curve". This corresponds to the fact that the AY cell voltage increases while the XY cell voltage is maintained at $V_{tXY}$. As the applied voltage increases, so does the AY cell voltage. When the AY cell voltage becomes the AY discharge starting threshold voltage $V_{tAY}$, at point I, simultaneous discharges occur between the X and Y electrodes and between the A and Y electrodes (hereinafter the simultaneous discharges are referred to as "XY and AY simultaneous discharges"). After the "XY and AY simultaneous discharges" have occurred, the cell voltage point is fixed at point I. An increase in the applied voltage only causes the wall voltage to be written, and the cell voltage vector remains unchanged.

The turned-OFF cell in FIG. 10B is at point J prior to resetting. Referring to the waveform shown in FIG. 6, at first the applied voltage changes step-wisely, and the cell voltage point moves to point K. Next, a discharge is initiated at point L upon application of the negative ramp wave, and the writing of the wall voltage starts. Since the discharge is the XY discharge, the writing direction has a slope of ½. The cell voltage is at point N at the end of the first ramp wave. In transition from the first ramp wave to the second ramp wave, the applied voltage suddenly changes, and the cell voltage point moves to point O. Upon application of the second ramp wave, a discharge is initiated at point P and the writing of the wall voltage starts. Since the discharge is the XY discharge, at first the wall voltage is written with a slope of ½. Subsequent to the start of the discharge, the cell voltage point moves upward along the "$V_t$ closed curve". This corresponds to the fact that the AY cell voltage increases while the XY cell voltage is maintained at $V_{tXY}$. As the applied voltage increases, so does the AY cell voltage. When the AY cell voltage becomes the AY discharge starting threshold voltage $V_{tAY}$, the "XY and AY simultaneous discharges" occur at point R. Subsequent to the simultaneous discharges, the cell voltage point is fixed at point R. An increase in the applied voltage only causes the wall voltage to be written, and the cell voltage vector remains unchanged.

When the resetting is normally done, the cell voltage point immediately after the end of the resetting is set to the upper-right vertex of the "$V_t$ closed curve" having a hexagonal shape, that is, a point representing the "XY and AY simultaneous discharges". The point is referred to as a "simultaneous resetting point". When the cell voltage reaches the "simultaneous resetting point", the XY wall voltage and the AY wall voltage are simultaneously adjusted to the corresponding values.

Whether the resetting is normally done or not greatly depends on the wall voltage prior to the start of resetting. In other words, even when the same resetting waveform is used, the resetting is normally done or not done depending on the previous wall voltage. The range of the wall voltage in which the resetting is normally done greatly depends on the amplitude of the resetting waveform applied voltage.

FIG. 11 shows a case in which the AY wall voltage prior to the start of resetting differs from that of FIG. 6 whereas the cases shown in FIGS. 6 and 11 have the same driving waveforms. In FIG. 6, the AY wall voltage of the turned-ON cell is zero. In FIG. 11, the AY wall voltage of the turned-ON cell is negative (please note that the sign is inverted).

Only the operation of the turned-ON cell (that is, the behavior of the wall voltage represented by the broken line) will now be discussed.

In the turned-ON cell, the XY wall voltage is written so that the XY cell voltage is maintained at $-V_{tYX}$ during a period from time (1) at which the XY cell voltage exceeds the YX discharge starting threshold voltage $-V_{tYX}$ to time at which the XY applied voltage amplitude becomes $-V_{XY1}$ and the AY applied voltage becomes $-V_{AY1}$. At the same time, the AY wall voltage changes. Since the change in the AY wall voltage is smaller than the change in the AY applied voltage, the absolute value of the AY cell voltage gradually increases. In this example, as in FIG. 6, the AY cell voltage does not exceed the AY discharge starting threshold voltage in the first step. Therefore, the AY cell voltage is not adjusted to the corresponding value. At the first step end time (3), only the XY wall voltage is set, whereas the AY wall voltage remains unset.

In the second step, the XY applied voltage and the AY applied voltage increase, and the XY cell voltage and the AY cell voltage increase. At time (4), the XY cell voltage exceeds the XY discharge starting threshold voltage $V_{tXY}$. Subsequent to time (4), the XY wall voltage is written so that the XY cell voltage is maintained at $V_{tXY}$. At the same time, the AY wall voltage is written. Since the change in the AY wall voltage is smaller than the change in the AY applied voltage, the absolute value of the AY cell voltage gradually increases. Even by time (5), the AY cell voltage does not exceed the AY discharge starting threshold voltage $V_{tAY}$ and the written AY wall voltage is not sufficient. At the resetting end time (6), the XY wall voltage is set, whereas the AY wall voltage remains unset.

As shown in FIGS. 3 and 5A, the driving waveforms in the resetting period are such that positive and negative driving waveforms, such as those shown in FIGS. 3 and 5A, are applied to the X electrode and the Y electrode, and the address electrode potential is fixed at zero. Therefore, the amplitude of the AY applied voltage is smaller than the amplitude of the XY applied voltage. The range of the wall voltage in which the AY wall voltage is normally reset thus becomes narrower. This results in an increase in the rate of resetting failure of the AY wall voltage. The PDP thus suffers from display problems such as turning ON extra cells or failing to turn ON the cells that must be turned ON.

SUMMARY OF THE INVENTION

Accordingly, it is an object of the present invention to provide a driving method for reducing PDP display problems that are caused by resetting by realizing a satisfactory resetting state involving appropriate resetting of XY and AY cell voltages.

In order to achieve the foregoing objects, the present invention realizes a satisfactory resetting state of a PDP by setting the PDP's discharge starting threshold voltages and driving waveform applied voltages to be in a predetermined relationship.

A PDP driving method according to a first aspect of the present invention is a method of driving a PDP including a plurality of Y electrodes arranged on a base plate, a plurality of X electrodes arranged between the plurality of Y electrodes, and a plurality of A electrodes crossing the X and Y electrodes. The method provides a recurring cycle of a resetting period during which resetting discharges are caused between the Y electrodes and the X electrodes, an addressing period during which addressing discharges are caused between the Y electrodes and the A electrodes, and a sustaining period during which sustaining discharges are caused between the Y electrodes and the X electrodes. The method includes applying at least one ramp waveform in the resetting period. When the Y electrodes serve as a cathode, $V_{tXY}$ denotes a discharge starting threshold voltage between the X electrodes and the Y electrodes, and $V_{tAY}$ denotes a discharge starting threshold voltage between the A electrodes and the Y electrodes. At the trailing edge of the ramp waveform at the end of the resetting period, $V_{XY}$ denotes a voltage applied between the X electrodes and the Y electrodes, and $V_{AY}$ denotes a voltage applied between the A electrodes and the Y electrodes on the basis of the Y electrodes. At the end of the sustaining period, $V_{aoff}$ denotes an offset voltage of the voltage applied between the A electrodes and the Y electrodes on the basis of the Y electrodes. In such a case, the voltage of a driving waveform for each electrode is set so as to satisfy the relational expression $2V_{tAY}-V_{tXY}<2V_{AY}-V_{XY}-2V_{aoff}$".

When a driving waveform having two or more types of offset voltages $V_{aoff}$ is used in the sustaining period, the PDP may be driven by setting the voltage of the driving waveform so as to satisfy the relational expression at the end of the sustaining period.

When a driving waveform having an alternating voltage with two or more types of amplitudes is used as a driving waveform to be applied between the A electrodes and the Y electrodes in the sustaining period, the PDP may be driven by setting the voltage of the driving waveform so as to satisfy the relational expression at the end of the sustaining period.

When the A electrodes serve as a cathode, $V_{tXA}$ denotes a discharge starting threshold voltage between the X electrodes and the A electrodes, and $V_{tYA}$ denotes a discharge starting threshold voltage between the Y electrodes and the A electrodes. When the X electrodes serve as a cathode, $V_{tAX}$ denotes a discharge starting threshold voltage between the A electrodes and the X electrodes, and $V_{tYX}$ denotes a discharge starting threshold voltage between the Y electrodes and the X electrodes. In such a case, the PDP arranged to satisfy the relational expression "$V_{tAY}+V_{tXA}-V_{tXY}>0$ or $V_{tYA}+V_{tAX}-V_{tYX}>0$" may be used.

In order to achieve the foregoing objects, the second group of the present invention generates driving waveforms that satisfy the above-described resetting conditional expression.

A PDP driving method according to another aspect of the present invention is a method of driving a PDP including a plurality of Y electrodes arranged on a base plate, a plurality of X electrodes arranged between the plurality of Y electrodes, and a plurality of A electrodes crossing the X and Y electrodes; the method providing a recurring cycle of a resetting period, an addressing period, and a sustaining period; the method including applying a ramp waveform in the resetting period, wherein a sustaining pulse applied in the sustaining period to each of the X electrodes and the Y electrodes includes an alternating pulse oscillating between both sides of a predetermined reference voltage at least in the beginning portion of the sustaining period and a pulse of positive voltage based on the reference potential at the end of the sustaining period.

The foregoing paragraph describes the PDP driving method of driving a PDP "including a plurality of Y electrodes arranged on a base plate, . . . the method including applying a ramp waveform in the resetting period", and the contents of which are incorporated by reference in the following specification by the phrase "when driving a PDP by applying a ramp wave according to the present invention".

In a driving method according to a further aspect of the present invention, when driving a PDP by applying a ramp wave according to the present invention, a waveform applied to the A electrodes in the sustaining period includes a constant voltage waveform of negative voltage based on a predetermined reference potential, which is applied at least at the end of the sustaining period.

The waveform applied to the A electrodes may be a constant voltage waveform of negative voltage based on the predetermined reference potential, which is applied during the entire sustaining period.

The waveform applied to the A electrodes may include a constant voltage waveform set at the level of the predetermined reference potential at least in the beginning portion of the sustaining period and a constant voltage waveform of negative voltage based on the reference potential, which is applied at the end of the sustaining period.

The reference potential may be regarded as at a ground level. A sustaining pulse applied to each of the X electrodes and the Y electrodes in the sustaining period may be an alternating pulse oscillating between both sides of the ground level.

The reference potential may be regarded as at a ground level. A sustaining pulse applied to each of the X electrodes and the Y electrodes in the sustaining period may be an alternating pulse of positive voltage based on the ground level.

In a driving method according to yet another aspect of the present invention, when driving a PDP by applying a ramp wave according to the present invention, a waveform applied to the A electrodes in the sustaining period includes a constant voltage waveform of positive voltage based on a predetermined reference potential at least in the beginning portion of the sustaining period and a constant voltage waveform at the level of the reference potential at the end of the sustaining period.

In a driving method according to a further aspect of the present invention, when driving a PDP by applying a ramp wave according to the present invention, a waveform applied to the A electrodes in the resetting period includes a constant voltage waveform of positive voltage based on a predetermined reference potential at the end of the resetting period.

The ramp waveform applied to at least one type of the X electrodes and the Y electrodes may include a first ramp wave having a positive ramp and a second ramp wave having a negative ramp.

In the resetting period, a waveform including the first ramp wave and the second ramp wave may be applied to the Y electrodes, and a constant voltage of opposite polarity corresponding to the first ramp wave and the second ramp wave may be applied to the X electrodes.

In order to achieve the foregoing objects, a third group of the present invention realizes a satisfactory resetting state of a PDP by setting driving waveform applied voltages that simultaneously initiate two types of resetting discharges.

In a driving method according to another aspect of the present invention, when driving a PDP by applying a ramp wave according to the present invention, at least one of a voltage between the A electrodes and the Y electrodes at the end of the resetting period, a voltage between the X electrodes and the Y electrodes at the end of the resetting period, and an offset voltage of a voltage applied between the A electrodes and the Y electrodes at the end of the sustaining period is set at a predetermined level. Two types of discharges including a discharge between the X electrodes and the Y electrodes and a discharge between the A electrodes and the Y electrodes are caused at the end of the resetting period.

DESCRIPTION OF THE PREFERRED EMBODIMENTS

The contents of the first group of the invention will now be described in detail.

Even when the same resetting waveforms are used, the resetting is normally done or not done depending on the wall voltage value. In order to design resetting waveforms that perform normal resetting, the relationship between the wall voltage state prior to the start of resetting and the resetting waveform applied voltages needs to be considered.

Figure 12:
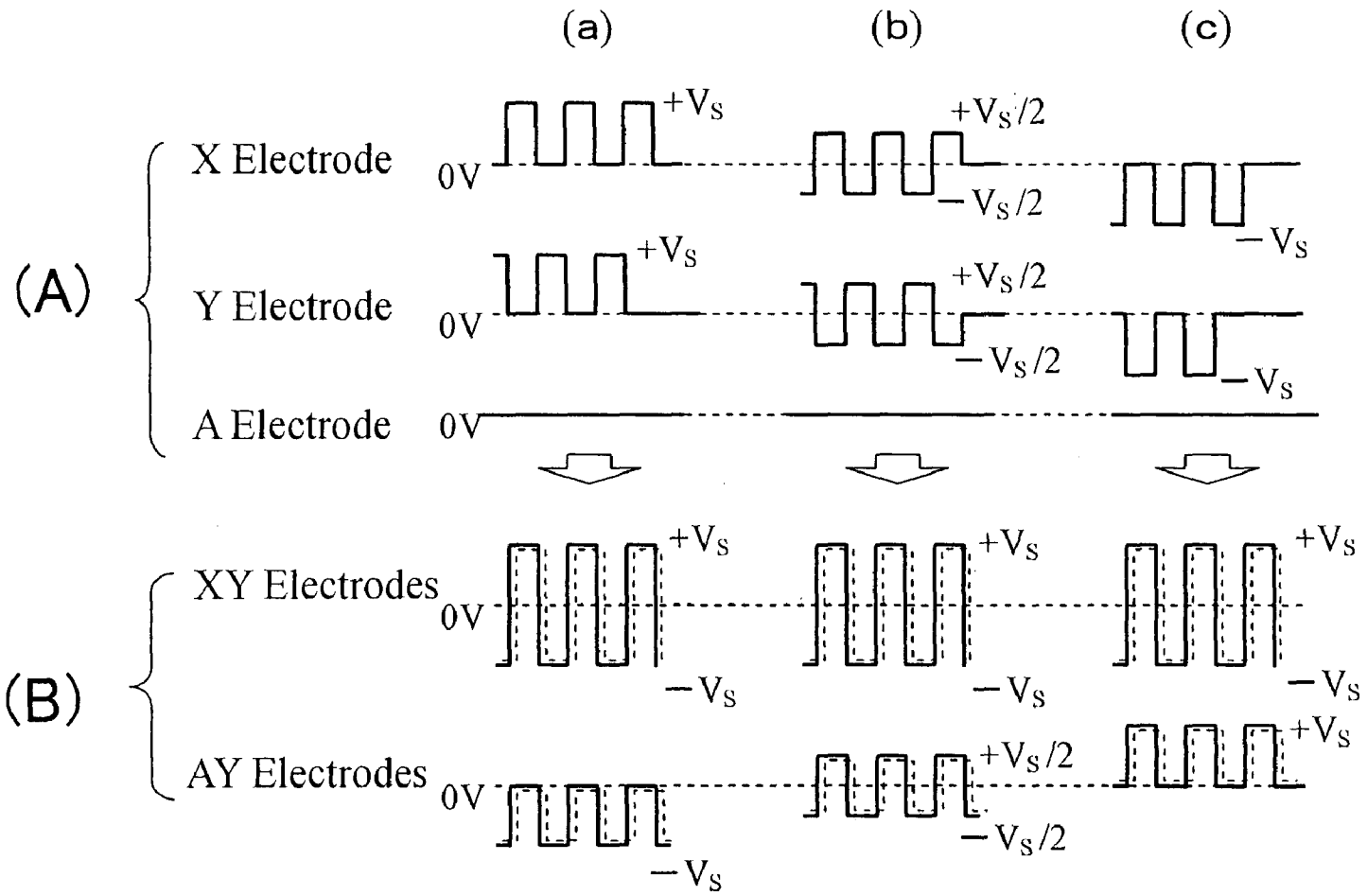
FIGS. 12A and 12B illustrate sustaining voltage waveforms and wall voltages of a turned-ON cell.

The wall voltage of a turned-ON cell will now be described. FIG. 12 shows three typical sustain waveforms. Portion (A) of FIG. 12 shows waveforms applied to the electrodes (X electrode, Y electrode, and A electrode), and portion (B) of FIG. 12 shows voltage waveforms applied between the X and Y electrodes and between the A and Y electrodes. Zero voltage is applied to the A electrode at all times. In contrast, portion (a) of FIG. 12 shows a case in which an alternating pulse of a voltage from 0 to $+V_S$ is applied to the X electrode and the Y electrode; portion (b) shows a case in which an alternating pulse of a voltage of $\pm V_S/2$ is applied to the X electrode and the Y electrode; and portion (c) shows a case in which an alternating pulse of a voltage from 0 to $-V_S$ is applied to the X electrode and the Y electrode. The waveforms of the XY applied voltages in cases (a) to (c) are the same, whereas the waveforms of the AY applied voltages in cases (a) to (c) have the same amplitude but different offsets.

Since a plurality of pulse trains is continuously applied in the sustaining period, the turned-ON cell is in its turned-ON steady state. The turned-ON steady state represents the wall voltage of the turned-ON cell. Referring to wall voltages in cases (a) to (c) of FIG. 12, the XY wall voltages are the same, whereas the AY wall voltages have the same amplitude but different offsets.

Figure 13:
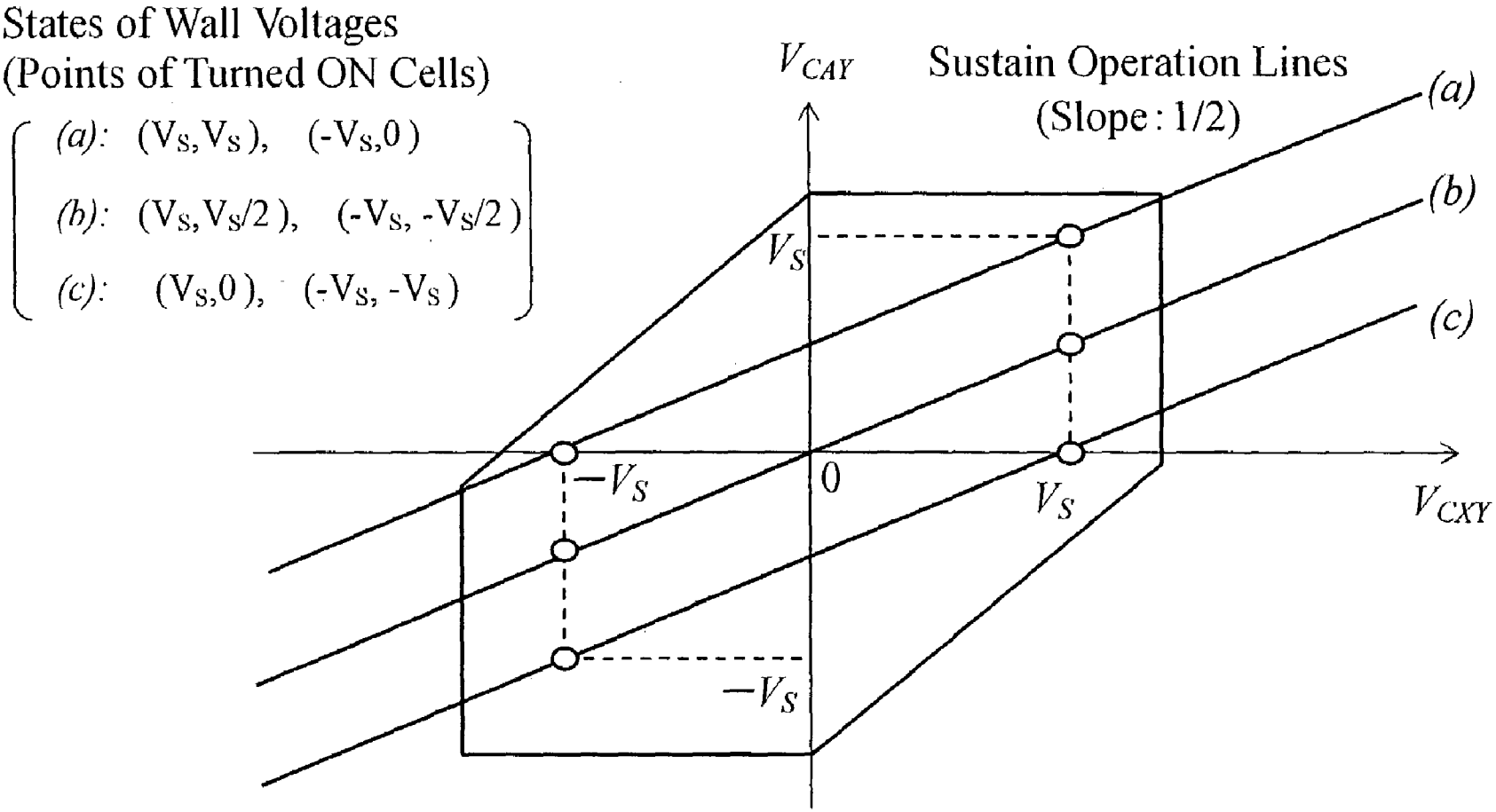
FIG. 13 illustrates the wall voltage positions in a sustaining period.

FIG. 13 is a diagram of a "cell voltage plane" having the wall voltages in cases (a) to (c) of FIG. 12 plotted therein. There are two wall voltages depending on the polarity of the XY applied pulse. Connecting each two wall voltage points in the sustaining period gives a line with a slope of ½. The intercepts between each such line and the ordinate correspond to the offsets of the AY wall voltages shown in FIG. 12. Hereinafter these lines are referred to as "sustain operation lines". The wall voltage of the turned-ON cell is one of two symmetrical points on each of the "sustain operation lines".

The relationship between the resetting waveform applied voltages and resetting performance will now be described.

Figure 14B:
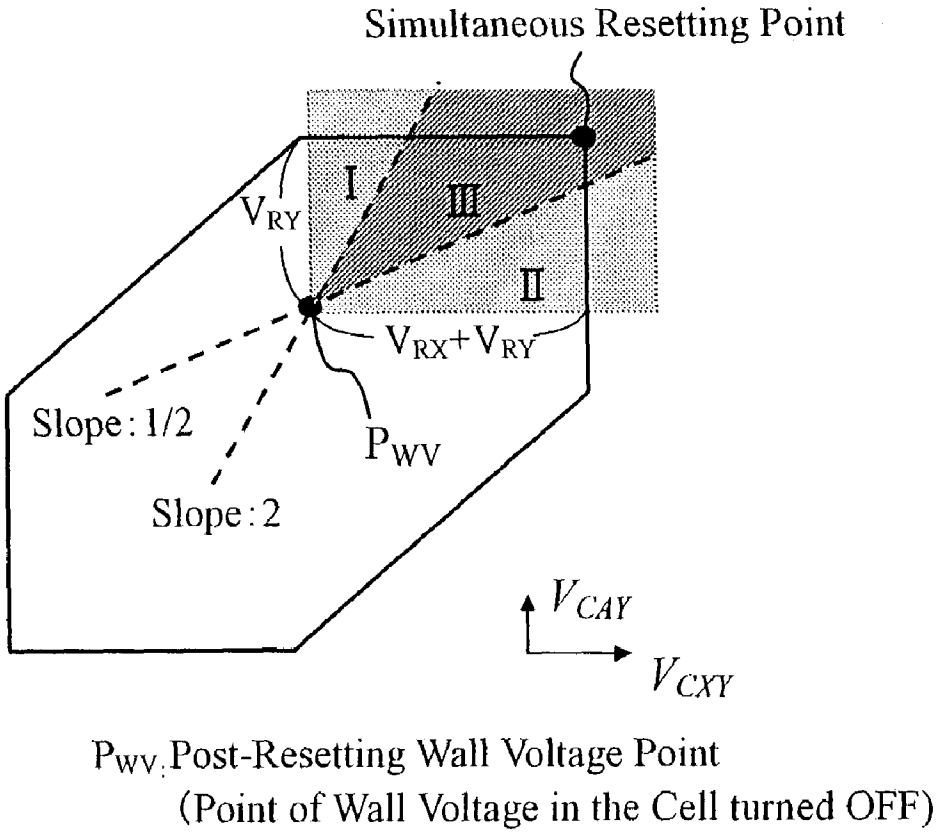
FIGS. 14A and 14B illustrate a wall voltage region in which simultaneous resetting is reliably performed by a last-step ramp wave.
Figure 14A:
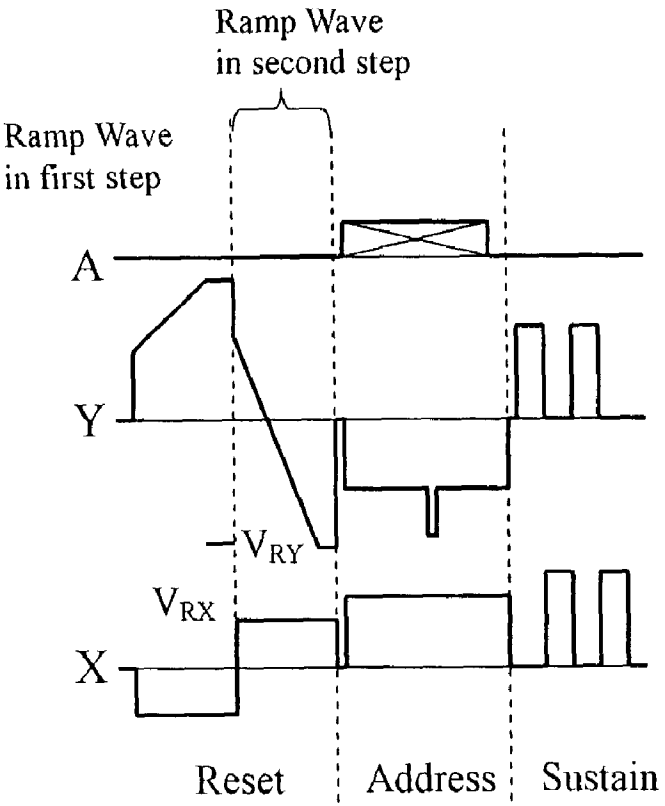

FIG. 14A shows PDP driving waveforms, and FIG. 14B shows wall voltage positions subsequent to normal resetting. In this case, each of the resetting waveforms is a two-step ramp wave consisting of a first step and a second step.

The word "ramp wave" refers to the "waveform of a gradually changing applied voltage" and generally refers to a positive ramp of gradually increasing voltage or a negative ramp of gradually decreasing voltage. The word "ramp wave" includes combinations of each of the two ramps and a constant voltage waveform, and further includes a combination of the combinations. The shape of the "gradually changing waveform" includes a linearly changing waveform and a curvedly changing waveform.

The amplitude of the second-step ramp wave applied to the X electrode is $+V_{RX}$, and the amplitude of the second-step ramp wave applied to the X electrode is $-V_{RY}$. When resetting is normally done, the cell voltage subsequent to the resetting is at a "simultaneous resetting point". A point displaced leftward by $V_{RX}+V_{RY}$ in the X and Y directions from the "simultaneous resetting point", or a point displaced downward by $V_{RY}$ in the A and Y directions from the "simultaneous resetting point", is a "post-resetting wall voltage point" $P_{WV}$. In the case of the turned-OFF cell, the wall voltage hardly changes in one SF. The wall voltage positions prior to and subsequent to resetting are approximately equal, which are approximately the same as the "post-resetting wall voltage point" $P_{WV}$.

In order to perform normal resetting, a discharge must be initiated by a last-step ramp wave (the word "last step" refers to the last step of a multi-step ramp wave; that is, the second step in the case of a two-step ramp wave, the third step in the case of a three-step ramp wave, and so forth). A region in which a discharge is caused by the second step ramp wave is an upper right region of the "post-resetting wall voltage point" $P_{WV}$.

When a discharge is initiated by the last-step ramp wave, the following three cases are possible: (I) a discharge is only initiated between the A and Y electrodes, and no simultaneous discharges occur; (II) a discharge is only initiated between the X and Y electrodes, and no simultaneous discharges occur; and (III) discharges are initiated between the A and Y electrodes and between the X and Y electrodes. Regions corresponding to (I), (II), and (III) are represented by reference numeral I, II, and III, respectively, in FIG. 14B. The slope of a wall voltage vector written by the XY discharge is ½, and the slope of a wall voltage vector written by the AY discharge is 2. The three regions are separated by two lines that pass through the "post-resetting wall voltage point" $P_{WV}$ and that have slopes 2 and ½, respectively.

Normal resetting is ensured only when the wall voltage point is moved to the region III of FIG. 14B prior to the start of the second step ramp wave. The region III is referred to as a "simultaneous resetting ensured region".

As described above, the amplitude of the AY applied voltage of the resetting waveform tends to be smaller than that of the XY applied voltage. Unless a voltage with a sufficiently large amplitude is applied to the Y electrode by the first step ramp wave, no AY discharge will be initiated. The ramp wave in the first step initiates the XY discharge that moves the wall voltage of the turned-ON cell in a direction with a slope of ½.

Figure 15:
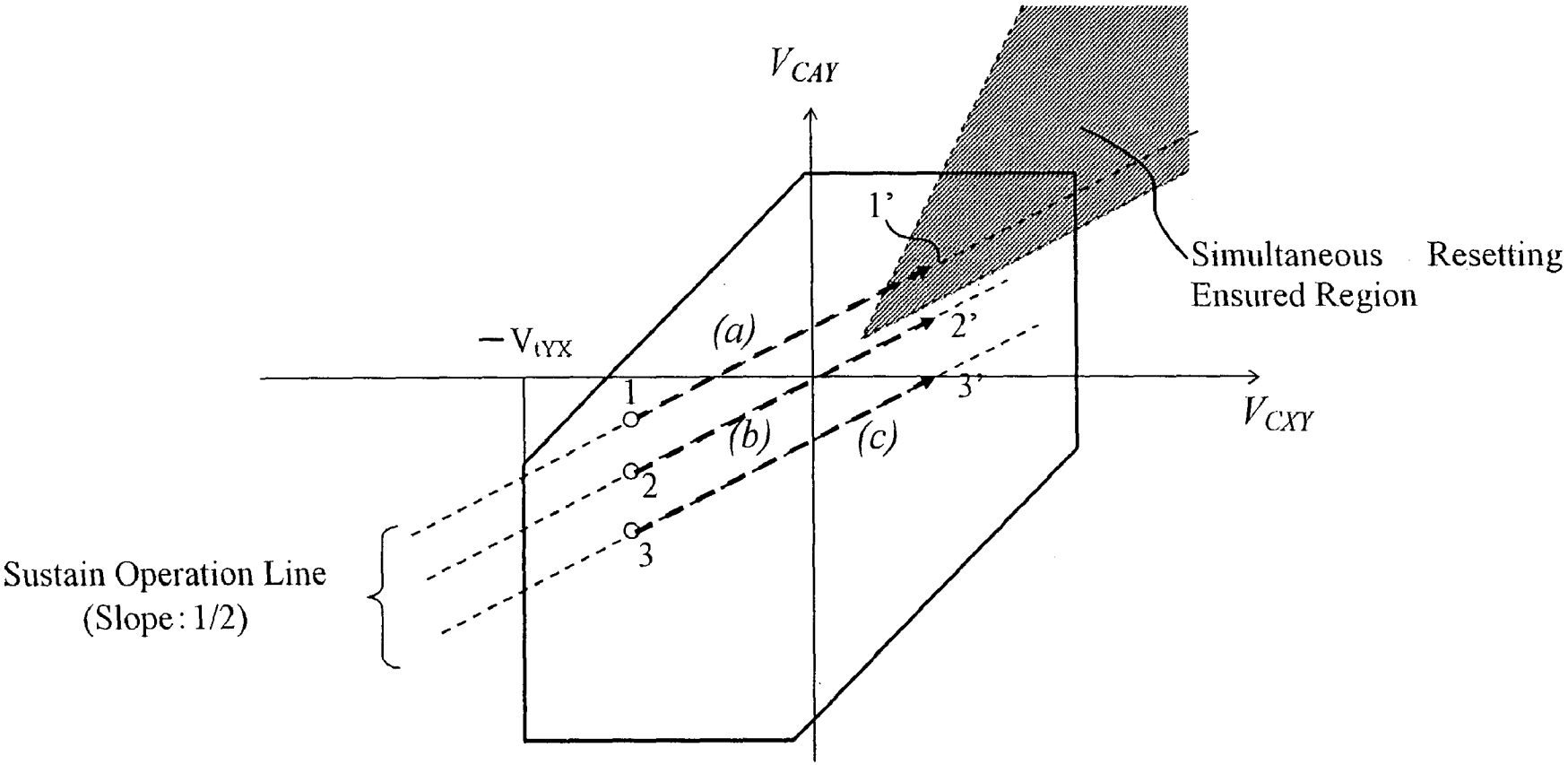
FIG. 15 illustrates the movement of the turned-ON cell to a simultaneous resetting ensured region.

FIG. 15 shows the manner in which the wall voltage point of the turned-ON cell shown in FIG. 13 is moved by the XY discharge initiated by the first-step ramp wave. In case (a) of FIG. 15, the "sustain operation line" and the "simultaneous resetting ensured region" overlap each other. The wall voltage point of the turned-ON cell moves from point 1 to point 1' that is in the "simultaneous resetting ensured region". The PDP's resetting state thus becomes satisfactory.

In contrast, in each of cases (b) and (c) of FIG. 15, the "sustain operation line" and the "simultaneous resetting ensured region" do not overlap each other. The wall voltage point is not moved to the "simultaneous resetting ensured region" only by the XY discharge.

In order to solve such problems in cases (b) and (c) of FIG. 15, the following measures are possible:

(1) The amplitude of the AY applied voltage in the first step of the resetting is increased in order that simultaneous discharges (XY discharge and AY discharge) are initiated by the last-step ramp wave. By increasing the amplitude, the wall voltage point of the turned-ON cell moves upward in the "cell voltage plane";

(2) The amplitude of the last-step ramp wave of the resetting waveform is increased, and the area of the "simultaneous resetting ensured region" is increased, thereby enabling the "sustain operation line" and the "simultaneous resetting ensured region" to overlap each other; or (3) The waveform in the sustaining period is adjusted to move the "sustain operation line" upward, thereby enabling the "simultaneous resetting ensured region" and the "sustain operation line" to overlap each other.

In (1), the amplitude of the voltage applied to the Y electrode is increased, or the amplitude of the voltage applied to the A electrode is increased. Since these voltages are generally set to their maximum in view of a driver's voltage resistance or the like, the further amplitude increase is difficult. For this reason, as in (2) or (3), the resetting state of the PDP is improved by increasing the amplitude of the last-step ramp wave of the resetting waveform or adjusting the sustain waveform.

The above discussion (especially the discussion with reference to FIGS. 14A, 14B, and 15) leads to the following conclusions.

In the first conclusion, a conditional expression for satisfying the relationship shown in case (a) of FIG. 15 is derived as follows.

When the Y electrode serves as the cathode, $V_{tAY}$ denotes a discharge starting threshold voltage for the AY discharge, and $V_{tXY}$ denotes a discharge starting threshold voltage for the XY discharge. With regard to the amplitude of the voltage of the last-step ramp wave in the resetting period, $V_{XY}$ denotes the XY applied voltage on the basis of the Y electrode, and $V_{AY}$ denotes the AY applied voltage on the basis of the Y electrode. With regard to the sustaining pulse in the sustaining period, $V_{aoff}$ denotes the offset voltage of the alternating pulse applied between the A and Y electrodes (on the basis of the Y electrode). In such a case, when the voltage relationship satisfies the following relational expression:

$$2V_{tAY}-V_{tXY}\leqq 2V_{AY}-V_{XY}-2V_{aoff}$$

the "sustain operation line" and the "simultaneous resetting ensured region" overlap each other. This relational expression is referred to as a "resetting conditional expression".

When the voltage of the driving waveform or threshold characteristics of the PDP are selected in order to satisfy the "resetting conditional expression", the PDP's resetting state becomes satisfactory.

With regard to the PDP's discharge start threshold voltages such as $V_{tAY}$ and $V_{tXY}$ in the left side of the "resetting conditional expression", the following condition for generating a "hexagonal $V_t$ closed curve" that serves as the basis of deriving the above relational expression needs to be satisfied:

$$V_{tAY}+V_{tXA}-V_{tXY}>0 \text{ or}$$

$$V_{tYA}+V_{tAX}-V_{tYX}>0.$$

By satisfying the additional conditional expression in addition to the "resetting conditional expression" described above, the satisfactory resetting state can be achieved.

Although a ramp wave consisting of two ramp waves has been used in the above description, a ramp wave consisting of one ramp wave or three or more ramp waves may be used as long as the ramp wave satisfies the above relational expressions. When the ramp wave consists of two ramp waves, the resetting conditional expression is satisfied more easily than the ramp wave consisting of one ramp wave. When the ramp wave consists of three or more ramp waves, the time required for resetting is further reduced. These are design-related matters of concern.

In the second conclusion of the above discussion, the state in each of cases (b) and (c) of FIG. 15 is improved to that in case (a) by increasing the amplitude of the last-step ramp wave of the resetting waveform or by adjusting the sustain waveform, whereby the above-described "resetting conditional expression" is satisfied. This corresponds to a second group of the present invention described below.

A description will be given of various driving waveforms for achieving a satisfactory resetting state or easing/improving the conditions for resetting driving waveforms and the specific contents for enabling the driving waveforms to satisfy the resetting conditional expression described above.

The specific contents of the resetting conditional expression are represented by "conditional expression: . . . " in the drawings used in the following description.

First Embodiment

Figure 16:
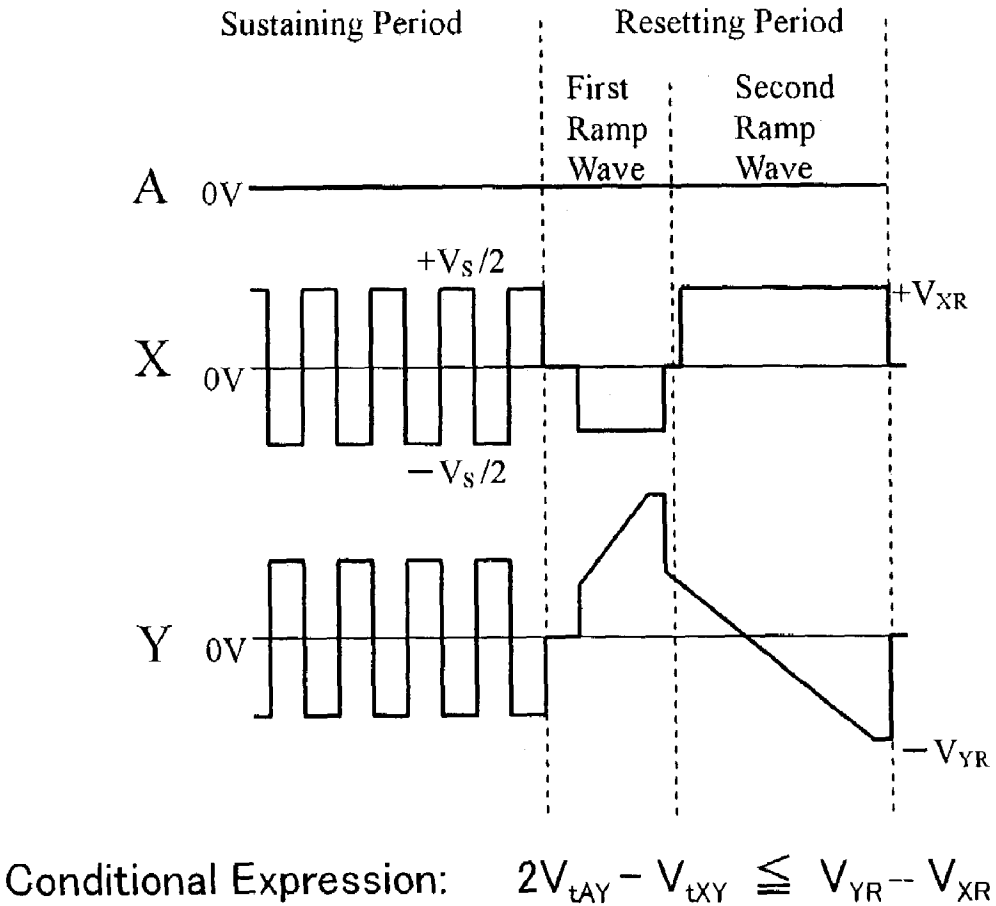
FIG. 16 illustrates driving waveforms according to a first embodiment of the present invention.

With reference to FIG. 16, driving waveforms and a resetting conditional expression according to a first embodiment of the present invention will be described.

In the first embodiment, a pulse train of $\pm V_S/2$ is applied to an X electrode and a Y electrode in a sustaining period, and the potential of an A electrode is fixed at GND potential. In view of the voltage between the electrodes, an alternating waveform of $\pm V_S$ is applied between the X and Y electrodes, and an alternating waveform of $\pm V_S/2$ is applied between the A and Y electrodes. The offset voltage of the AY applied voltage in the sustaining period (i.e., AY wall voltage) is zero.

The resetting conditional expression according to the first embodiment is:

$$2V_{tAY}-V_{tXY}<V_{YR}-V_{XR};$$

Since a typical value for the discharge starting threshold voltage $V_{tAY}$ is approximately 200 V, and a typical value for the discharge starting threshold voltage $V_{tXY}$ is approximately 230 V, the following holds true:

$$2V_{tAY}-V_{tXY}=170.$$

By setting the following to 170 V or greater:

$$V_{YR}-V_{XR}$$

"XY and AY simultaneous discharges" are caused by a last-step ramp wave. After the resetting is completed, XY wall voltages and AY wall voltages of a turned-ON cell and a turned-OFF cell are adjusted to the corresponding values, respectively.

Second Embodiment

Figure 17:
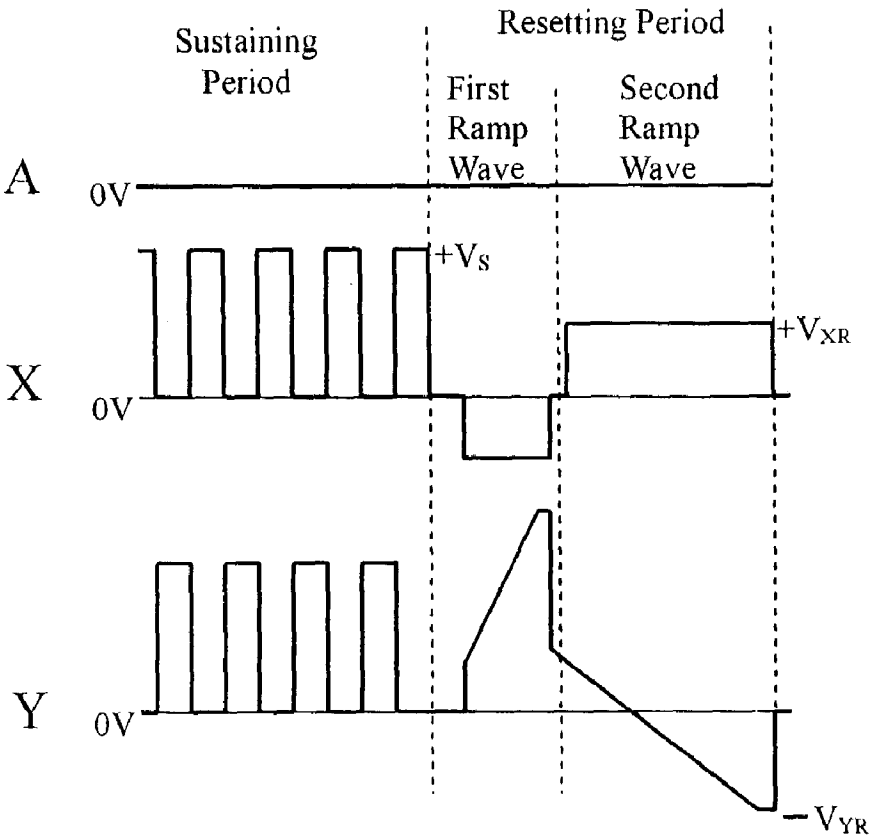
FIG. 17 illustrates driving waveforms according to a second embodiment of the present invention.

With reference to FIG. 17, driving waveforms and a resetting conditional expression according to a second embodiment of the present invention will now be described.

A sustain driving waveform consisting of an alternating pulse from 0 to $V_S$ is applied to the X electrode and the Y electrode, and the potential of the address electrode is fixed at zero. When the amplitude of the voltage applied to the X electrode $V_{XR}$ and the amplitude of the voltage applied to the Y electrode $-V_{YR}$ by the second step ramp wave of the resetting waveform satisfy the following resetting conditional expression:

$$2V_{tAY}-V_{tXY} \leqq V_{YR}-V_{XR}+V_S$$

the "simultaneous resetting ensured region" and the "sustain operation line" correspond to the relationship in case (a) of FIG. 15.

As in the first embodiment, the general setting is as follows:

$$2V_{tAY}-V_{tXY}=170.$$

By setting the following to 170 V or greater:

$$V_{YR}-V_{XR}+V_S$$

the "XY and AY simultaneous discharges" are caused by the last-step ramp wave (the second-step ramp wave in the case shown in the drawing). After the resetting is completed, the XY wall voltages and AY wall voltages of the turned-ON cell and the turned-OFF cell are adjusted to the corresponding values, respectively.

The resetting condition of the second embodiment is more favorable than that of the first embodiment since the right side of the resetting conditional expression includes the term "$+V_S$".

In other words, compared with the first embodiment, the second embodiment is characterized in that the AY applied voltage in the sustaining period (i.e., AY wall voltage) has an offset of $-V_S/2$ (thus, the AY wall voltage has an offset of $+V_S/2$). With the offset voltage, the voltage amplitude of the first or second ramp waveform in the resetting period is reduced.

Third Embodiment

Figure 18:
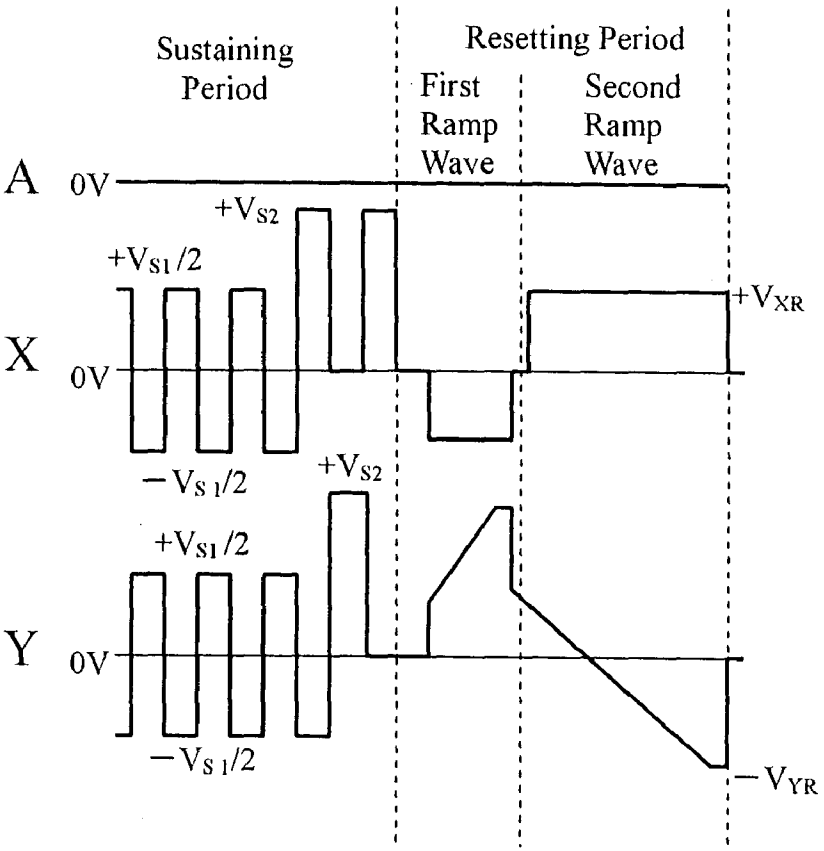
FIG. 18 illustrates driving waveforms according to a third embodiment of the present invention.

With reference to FIG. 18, driving waveforms and a resetting conditional expression according to a third embodiment of the present invention will now be described. A sustain driving waveform of the third embodiment is regarded as a waveform that is based on the driving waveform of the first embodiment and that has a few pulses at the end of the sustaining period, to which the sustaining pulse of the second embodiment is applied.

The sustain driving waveform applies an alternating pulse of $\pm V_{S1}/2$ to the X electrode and the Y electrode immediately prior to the end of the sustaining period and an alternating pulse from 0 to $V_{S2}$ until the end of the sustaining period. The potential of the address electrode is set at zero.

When the amplitude of the voltage applied to the X electrode $V_{XR}$ and the amplitude of the voltage applied to the Y electrode $-V_{YR}$ by the second step ramp wave of the resetting waveform and the above-described $V_{S2}$ satisfy the following resetting conditional expression:

$$2V_{tAY}-V_{tXY} \leqq V_{YR}-V_{XR}+V_{S2}$$

the "simultaneous resetting ensured region" and the "sustain operation line" correspond to the relationship in case (a) of FIG. 15.

As in the first embodiment, the general setting is as follows:

$$2V_{tAY}-V_{tXY}=170.$$

By setting the following to 170 V or greater:

$$V_{YR}-V_{XR}+V_{S2}$$

the "XY and AY simultaneous discharges" are caused by the last-step ramp wave (the second-step ramp wave in the case shown in the drawing). After the resetting is completed, the XY wall voltages and AY wall voltages of the turned-ON cell and the turned-OFF cell are adjusted to the corresponding values, respectively.

By replacing $V_S$ in the resetting conditional expression of the second embodiment by $V_{S2}$, the equivalent expression is derived. When $V_S=V_{S2}$, the equivalent resetting effect can be achieved in both cases.

According to the third embodiment, the pulse-at-the end of the sustaining period is such that the waveform of the AY applied voltage having a negative offset is used to have a positive offset of the AY wall voltage. More specifically, the offset of the AY applied voltage in the first half of the sustaining period is zero, whereas the offset of the AY applied voltage by a pulse train at the end of the sustaining period is negative. Due to the pulse train at the end of the sustaining period, the offset of the AY wall voltage immediately prior to the start of the resetting period is positive. As a result, the voltage amplitude of the first or second ramp wave of the resetting waveform is reduced.

Fourth Embodiment

Figure 19:
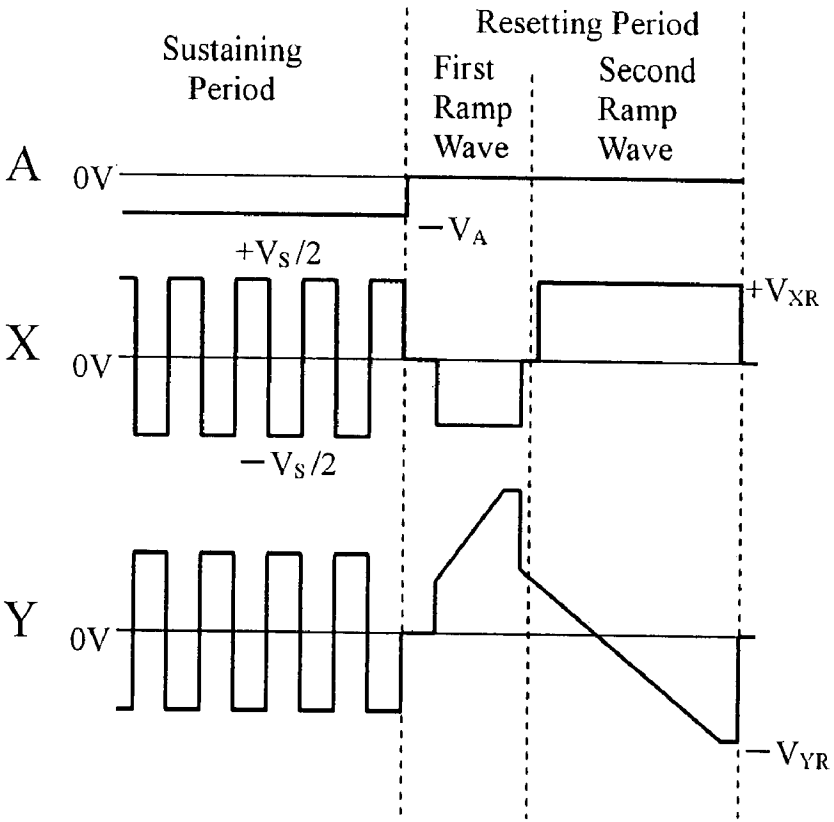
FIG. 19 illustrates driving waveforms according to a fourth embodiment of the present invention.

With reference to FIG. 19, driving waveforms and a resetting conditional expression according to a fourth embodiment of the present invention will now be described. Particularly, the fourth embodiment refers to the improvement in the driving waveform for the A electrode in the sustaining period.

The sustain driving waveform applies an alternating pulse of $\pm V_S/2$ to the X electrode and the Y electrode. The potential of the address electrode is set to negative ($-V_A$). When the amplitude of the voltage applied to the X electrode $V_{XR}$ and the amplitude of the voltage applied to the Y electrode $-V_{YR}$ by the second step ramp wave of the resetting waveform and the potential of the address electrode $-V_A$ satisfy the following resetting conditional expression:

$$2V_{tAY}-V_{tXY} \leqq V_{YR}-V_{XR}+2V_A$$

the "simultaneous resetting ensured region" and the "sustain operation line" correspond to the relationship in case (a) of FIG. 15.

As in the first embodiment, the general setting is as follows:

$$2V_{tAY}-V_{tXY}=170.$$

By setting the following to 170 V or greater:

$$V_{YR}-V_{XR}+2V_A$$

the "XY and AY simultaneous discharges" are caused by the last-step ramp wave (the second-step ramp wave in the case shown in the drawing). After the resetting is completed, the XY wall voltages and AY wall voltages of the turned-ON cell and the turned-OFF cell are adjusted to the corresponding values, respectively.

Compared with the first embodiment, the fourth embodiment is characterized in that the right side of the resetting conditional expression includes "$+2V_A$". As in "$+V_S$" of the second embodiment and the "$+V_{s2}$" of the third embodiment, the resetting condition is more favorable because of the term "$+2V_A$".

According to the fourth embodiment, the potential of the A electrode in the sustaining period is made negative to make the offset of the AY wall voltage accumulated in the sustaining period positive. Accordingly, the offset of the AY wall voltage immediately prior to the resetting period becomes positive, and the voltage amplitude of the first or second ramp wave of the resetting waveform is thus reduced.

Fifth Embodiment

Figure 20:
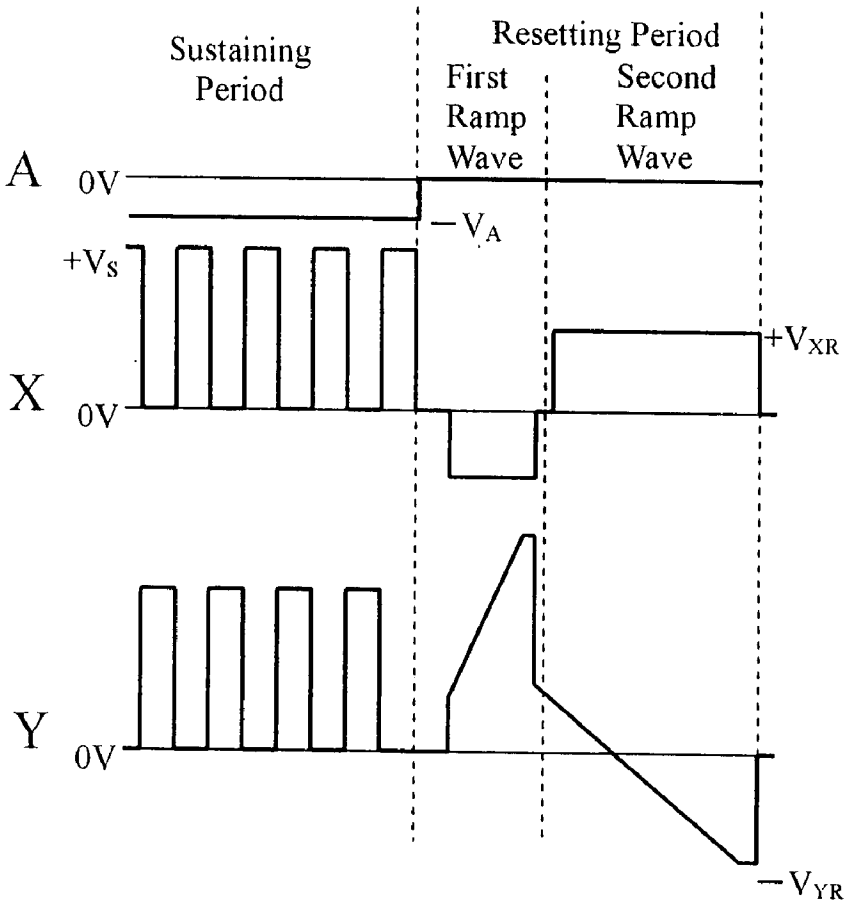
FIG. 20 illustrates driving waveforms according to a fifth embodiment of the present invention.

With reference to FIG. 20, driving waveforms and a resetting conditional expression according to a fifth embodiment of the present invention will now be described. The fifth embodiment can be regarded as a combination of the driving waveforms of the second embodiment and the driving waveform for the A electrode of the fourth embodiment.

The sustain driving waveform applies an alternating pulse from 0 to $V_S$ to the X electrode and the Y electrode. The potential of the address electrode is set to negative ($-V_A$). When the amplitude of the voltage applied to the X electrode $V_{XR}$ and the amplitude of the voltage applied to the Y electrode $-V_{YR}$ by the second step ramp wave of the resetting waveform and the potential of the address electrode $-V_A$ satisfy the following resetting conditional expression:

$$2V_{tAY}-V_{tXY}\leqq V_{YR}-V_{XR}+2V_A+V_S$$

the "simultaneous resetting ensured region" and the "sustain operation line" correspond to the relationship in case (a) of FIG. 15.

As in the first embodiment, the general setting is as follows:

$$2V_{tAY}-V_{tXY}=170.$$

By setting the following to 170 V or greater:

$$V_{YR}V_{XR}+2V_A+V_S$$

the "XY and AY simultaneous discharges" are caused by the last-step ramp wave (the second-step ramp wave in the case shown in the drawing). After the resetting is completed, the XY wall voltages and AY wall voltages of the turned-ON cell and the turned-OFF cell are adjusted to the corresponding values, respectively.

Compared with the second embodiment, the fifth embodiment is characterized in that the right side of the resetting conditional expression further includes "$+2V_A$". Because of the term "$+2V_A$", the resetting condition is more favorable.

Sixth Embodiment

Figure 21:
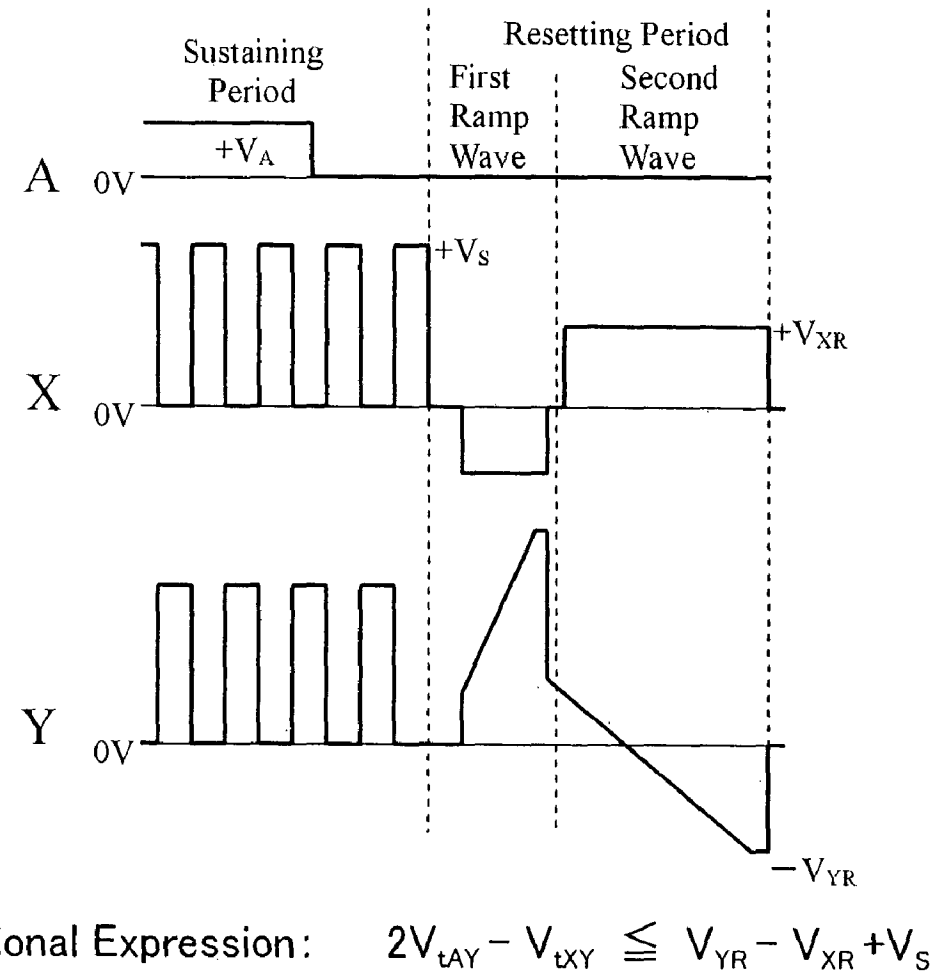
FIG. 21 illustrates driving waveforms according to a sixth embodiment of the present invention.

With reference to FIG. 21, driving waveforms and a resetting conditional expression according to a sixth embodiment of the present invention will now be described.

The sustain driving waveform applies an alternating pulse from 0 to $V_S$ to the X electrode and the Y electrode. Although the potential of the address electrode (A electrode) in a large portion of the sustaining period is $+V_A$, the potential of the A electrode corresponding to a few pulses at the end of the sustaining period is fixed at zero.

The potential of the address electrode in the sustaining period is set to $+V_A$ because this is advantageously effective in stabilizing the transitional operation from the addressing period to the sustaining period. However, when the potential of the address electrode remains unchanged, the resetting condition becomes disadvantageous (the reason thereof will be described later). Therefore, the potential of the A electrode corresponding to a few pulses at the end of the sustaining period is fixed at zero.

When the amplitude of the voltage applied to the X electrode $V_{XR}$ and the amplitude of the voltage applied to the Y electrode $-V_{YR}$ by the second step ramp wave of the resetting waveform satisfy the following resetting conditional expression:

$$2V_{tAY}-V_{tXY}\leqq V_{YR}-V_{XR}+V_S$$

the "simultaneous resetting ensured region" and the "sustain operation line" correspond to the relationship in case (a) of FIG. 15.

As in the first embodiment, the general setting is as follows:

$$2V_{tAY}-V_{tXY}=170.$$

By setting the following to 170 V or greater:

$$V_{YR}-V_{XR}+V_S$$

the "XY and AY simultaneous discharges" are caused by the last-step ramp wave (the second-step ramp wave in the case shown in the drawing). After the resetting is completed, the XY wall voltages and AY wall voltages of the turned-ON cell and the turned-OFF cell are adjusted to the corresponding values, respectively.

As is clear from the resetting conditional expression, the resetting state according to the sixth embodiment is substantially equivalent to that of the second embodiment.

When the potential of the A electrode at the end of the sustaining period is set to $+V_A$, as in the first half of the sustaining period, "$-2V_A$" is added to the right side of the resetting conditional expression. Because of the term "$-2V_A$", the resetting condition becomes disadvantageous, which needs to be considered.

Seventh Embodiment

Figure 22:
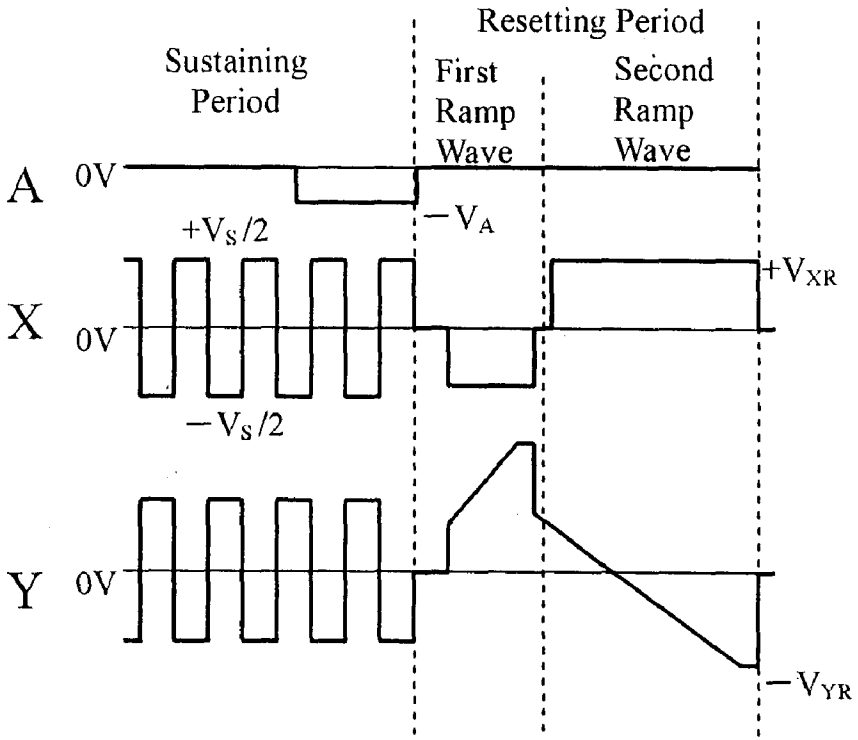
FIG. 22 illustrates driving waveforms according to a seventh embodiment of the present invention.

With reference to FIG. 22, driving waveforms and a resetting conditional expression according to a seventh embodiment of the present invention will now be described. The seventh embodiment corresponds to an intermediate embodiment between the first and fourth embodiments.

The sustain driving waveform applies an alternating pulse of $\pm V_S$ to the X electrode and the Y electrode. Although the potential of the address electrode (A electrode) in a large portion of the sustaining period is zero, the potential of the A electrode corresponding to a few pulses at the end of the sustaining period is fixed at $-V_A$. The potential of the A electrode at the end of the sustaining period is fixed at $-V_A$ in order to improve the resetting condition. This becomes clear from the following resetting conditional expression.

When the amplitude of the voltage applied to the X electrode $V_{XR}$ and the amplitude of the voltage applied to the Y electrode $-V_{YR}$ by the second step ramp wave of the resetting waveform and the potential of the address electrode $-V_A$ satisfy the following resetting conditional expression:

$$2V_{tAY}-V_{tXY}\leqq V_{YR}-V_{XR}+2V_A$$

the "simultaneous resetting ensured region" and the "sustain operation line" correspond to the relationship in case (a) of FIG. 15.

As in the first embodiment, the general setting is as follows:

$$2V_{tAY}-V_{tXY}=170.$$

By setting the following to 170 V or greater:

$$V_{YR}-V_{XR}+2V_A$$

the "XY and AY simultaneous discharges" are caused by the last-step ramp wave (the second-step ramp wave in the case shown in the drawing). After the resetting is completed, the XY wall voltages and AY wall voltages of the turned-ON cell and the turned-OFF cell are adjusted to the corresponding values, respectively.

Compared with the first embodiment, the seventh embodiment is characterized by the term "$+2V_A$" in the right side. Because of the term "$+2V_A$", the resetting condition becomes more favorable. (Also, the resetting conditional expression is equivalent to that of the fourth embodiment.)

According to the seventh embodiment, the potential of the A electrode at the end of the sustaining period is made negative to make the offset of the AY wall voltage accumulated in the sustaining period positive. Accordingly, the offset of the AY wall voltage immediately prior to the start of the resetting period becomes positive, and the voltage amplitude of the first or second ramp wave of the resetting waveform is thus reduced.

Eighth Embodiment

Figure 23:
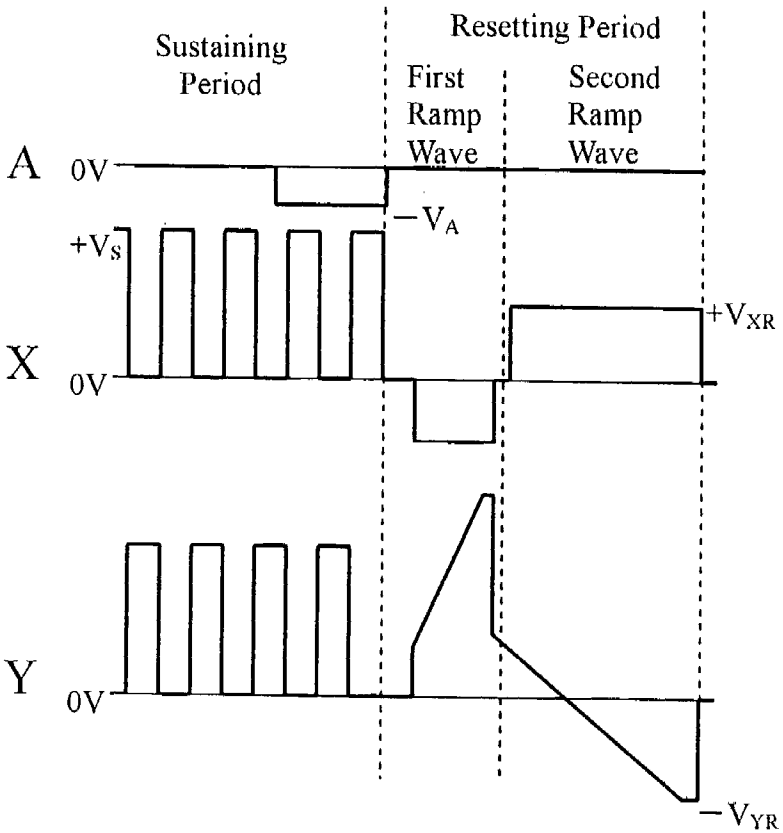
FIG. 23 illustrates driving waveforms according to an eighth embodiment of the present invention.

With reference to FIG. 23, driving waveforms and a resetting conditional expression according to an eighth embodiment of the present invention will now be described. The eighth embodiment corresponds to an intermediate embodiment between the second and fifth embodiments.

The sustain driving waveform applies an alternating pulse from 0 to $V_S$ to the X electrode and the Y electrode. Although the potential of the address electrode (A electrode) in a large portion of the sustaining period is zero, the potential of the A electrode corresponding to a few pulses at the end of the sustaining period is fixed at $-V_A$. The potential of the A electrode at the end of the sustaining period is fixed at $-V_A$ in order to improve the resetting condition. This becomes clear from the following resetting conditional expression.

When the amplitude of the voltage applied to the X electrode $V_{XR}$ and the amplitude of the voltage applied to the Y electrode $-V_{YR}$ by the second step ramp wave of the resetting waveform and the potential of the address electrode $-V_A$ satisfy the following resetting conditional expression:

$$2V_{tAY}-V_{tXY}\leqq V_{YR}-V_{XR}+V_S+2V_A$$

the "simultaneous resetting ensured region" and the "sustain operation line" correspond to the relationship in case (a) of FIG. 15.

As in the first embodiment, the general setting is as follows:

$$2V_{tAY}-V_{tXY}=170.$$

By setting the following to 170 V or greater:

$$V_{YR}-V_{XR}+V_S+2V_A$$

the "XY and AY simultaneous discharges" are caused by the last-step ramp wave (the second-step ramp wave in the case shown in the drawing). After the resetting is completed, the XY wall voltages and AY wall voltages of the turned-ON cell and the turned-OFF cell are adjusted to the corresponding values, respectively.

Compared with the second embodiment, the eighth embodiment is characterized by the term "$+2V_A$" in the right side. Because of the term "$+2V_A$", the resetting condition becomes more favorable. (Also, the resetting conditional expression is equivalent to that of the fifth embodiment.)

Ninth Embodiment

Figure 24:
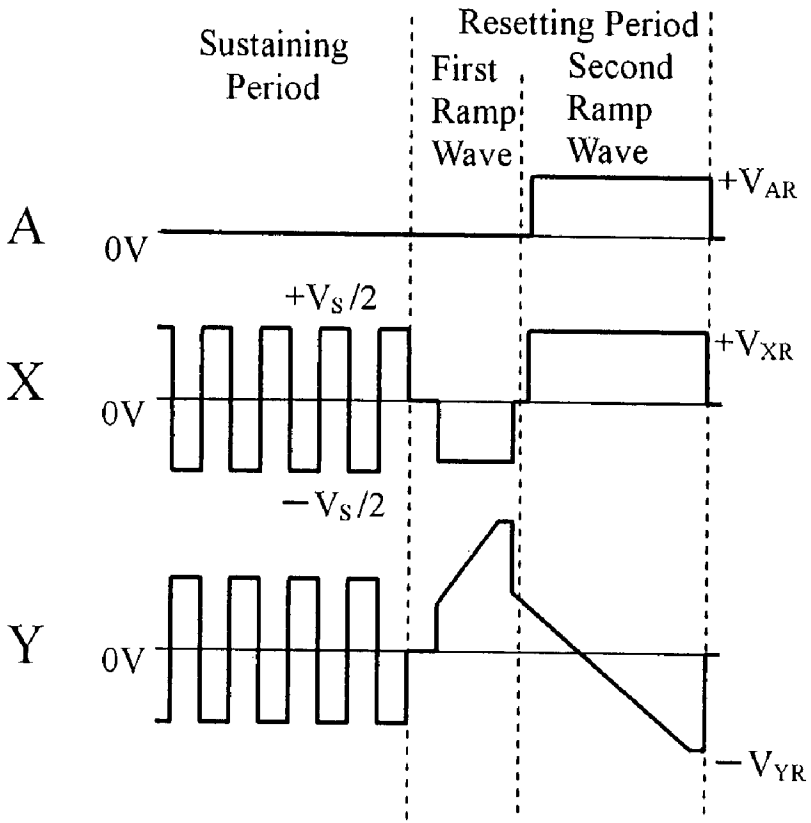
FIG. 24 illustrates driving waveforms according to a ninth embodiment of the present invention.

With reference to FIG. 24, driving waveforms and a resetting conditional expression according to a ninth embodiment of the present invention will now be described. The ninth embodiment is characterized in that the potential of the A electrode in the resetting period is set to positive. In this respect, the ninth embodiment differs from the first to eighth embodiments described above.

Referring to FIG. 24, in the sustaining period, a pulse train of $\pm V_S/2$ is applied to the X electrode and the Y electrode, and the potential of the A electrode is fixed at GND potential. In view of the voltage between the electrodes, an alternating waveform of $\pm V_S$ is applied between the X and Y electrodes, and an alternating waveform of $\pm V_S/2$ is applied between the A and Y electrodes. In a period in which the second ramp wave is applied in the resetting period, the A electrode is fixed at a positive potential of $+V_{AR}$. Upon application of $+V_{AR}$, the resetting condition is improved to a satisfactory level. This becomes clear from the following resetting conditional expression.

When the amplitude of the voltage applied to the X electrode $V_{XR}$ and the amplitude of the voltage applied to the Y electrode $-V_{YR}$ by the second step ramp wave of the resetting waveform and the potential of the address electrode $+V_{AR}$ satisfy the following resetting conditional expression:

$$2V_{tAY}-V_{tXY}\leqq 2V_{AR}+V_{YR}-V_{XR}$$

the "simultaneous resetting ensured region" and the "sustain operation line" correspond to the relationship in case (a) of FIG. 15.

As in the first embodiment, the general setting is as follows:

$$2V_{tAY}-V_{tXY}=170.$$

By setting the following to 170 V or greater:

$$2V_{AR}+V_{XR}-V_{XR}$$

the "XY and AY simultaneous discharges" are caused by the last-step ramp wave (the second-step ramp wave in the case shown in the drawing). After the resetting is completed, the XY wall voltages and AY wall voltages of the turned-ON cell and the turned-OFF cell are adjusted to the corresponding values, respectively.

Compared with the first embodiment, the ninth embodiment is characterized by the term "$2V_{AR}$" in the right side. Because of the term "$+2V_A$, the resetting condition becomes more favorable.

Although the positive potential applied to the A electrode $+V_{AR}$ is applied in the second ramp wave application period in FIG. 24, the positive potential $+V_{AR}$ may be applied only at the end of the second ramp wave application period or during the entire resetting period. The positive potential $+V_{AR}$ can be applied at any time as long as the A electrode is fixed at the positive potential $+V_{AR}$ at least at the end of the resetting period.

FIG. 24 shows a case corresponding to the first embodiment. By setting the potential of the A electrode in the resetting period in the case of the second to eighth embodiments in a manner similar to FIG. 24, advantages similar to the case of FIG. 24 can be achieved.

For example, when the potential of the A electrode in the resetting period in the fifth or eighth embodiment is set in a manner similar to FIG. 24, the resetting conditional expression in both cases becomes:

$$2V_{tAY}-V_{tXY}\leq 2V_{AR}+V_{YR}-V_{XR}+V_S+2V_A.$$

When $V_{AR}$ and $V_A$ are set to the same value, that is, $$V_{AR}=V_A,$$

the following resetting conditional expression is derived:

$$2V_{tAY}-V_{tXY}\leq V_{YR}-V_{XR}+V_S+4V_A.$$

The resetting conditional expression is equivalent to that of the fifth or eight embodiment except for the replacement of "$+2V_A$" in the right side by "$+4V_A$". Because of an increase of "$+2V_A$", the resetting condition becomes more favorable than that of the fifth or eighth embodiment.

When such a driving waveform that fixes the potential of the A electrode at a positive potential of $+V_{AR}$ is used at least at the end of the resetting period, an address pulse that is based on $+V_{AR}$ needs to be applied in the subsequent addressing period.

($V_t$ Closed Curve and Method of Measuring Six Types of Discharge Starting Threshold Voltages)

Figure 25B:
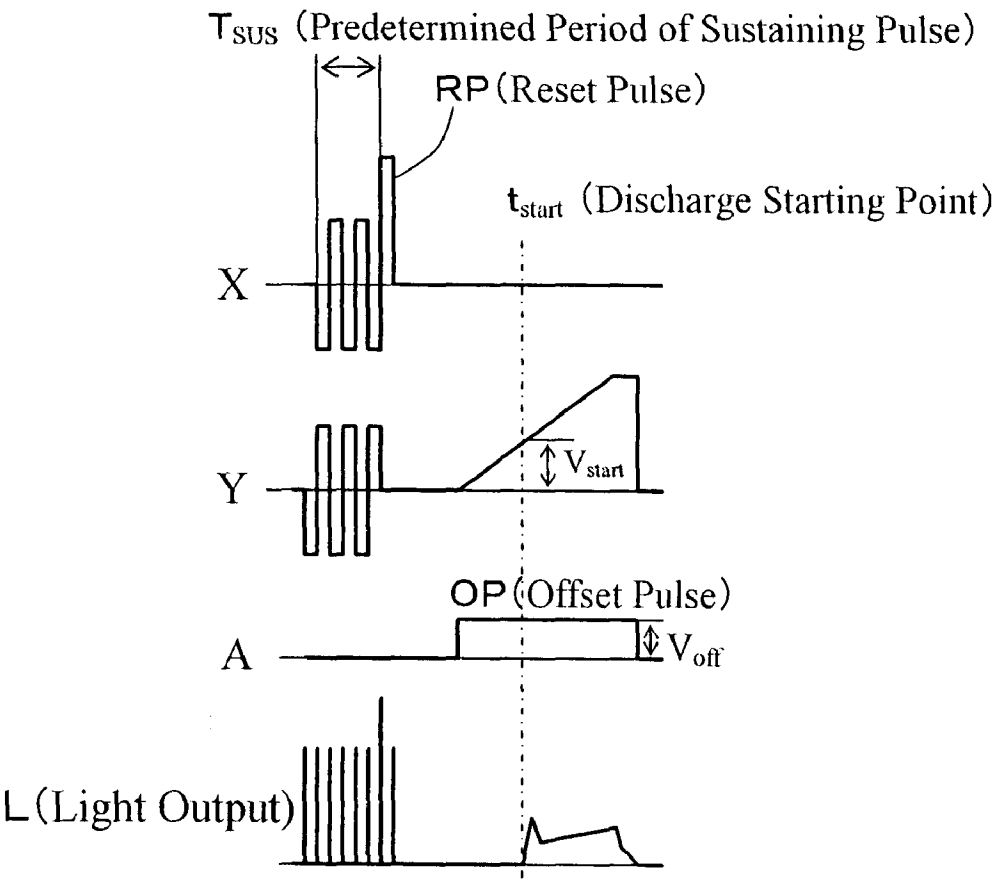
FIGS. 25A and 25B illustrate a method of measuring the $V_t$ closed curve and discharge starting threshold voltages.
Figure 25A:
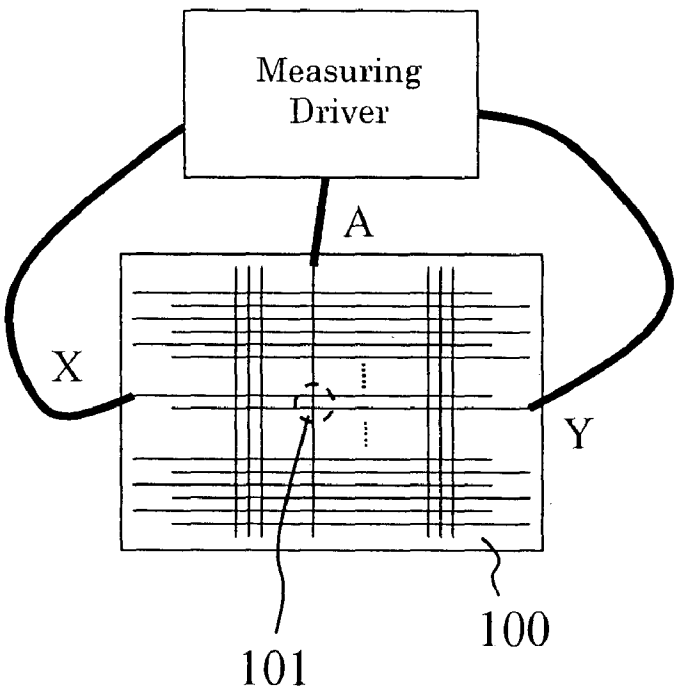

For example, the left side of the expression as set forth in claim 1 includes the PDP's discharge starting threshold voltages ($V_{tAY}$ and $V_{tXY}$). With reference to FIGS. 25A and 25B, a method of measuring such discharge starting threshold voltages will be described.

Referring to FIG. 25A, a measuring driver is connected to a specific display electrode X, a scanning electrode Y, and an address electrode A of a PDP panel 100. An optical probe is used to observe light emitted from a portion 101 (broken-line circle) corresponding to a cell determined by these electrodes.

FIG. 25B shows voltage waveforms of the measuring driver. In order to preliminarily have the cell in a predetermined charge state, the measuring driver applies an alternating pulse to the display electrode X and the scanning electrode Y for a predetermined period $T_{SUS}$. Then, resetting is done using a self-erasing discharge, and the charge state of the cell becomes zero. Referring to FIG. 25B, a very large voltage pulse (reset pulse RP) is applied to the display electrode X. Upon application of such a large voltage, a strong discharge is initiated to generate a large amount of wall charge. When the large pulse falls, the voltage applied to each electrode becomes zero. Since there is a large amount of wall charge generated by the previous discharge, a strong electric field is created in the cell. A discharge is initiated only by the electric field. As a result, the wall charge in the cell vanishes. The discharge is referred to as a self-erasing discharge. Almost the entire wall charge in the cell vanishes after a large self-erasing discharge is initiated by the above-described reset pulse PR.

Continuously, the discharge starting threshold voltages are measured. In order to determine the cell voltage at the start of a discharge, a gradually increasing waveform (ramp wave) is applied to one of three electrodes, and a large-width pulse voltage OP (offset pulse) is applied to any one of the remaining two electrodes. The voltage of the last remaining electrode is fixed at ground potential. FIG. 25B shows a case in which the ramp wave is applied to the scanning electrode Y, the offset pulse OP is applied to the address electrode A, and the display electrode X is fixed at ground potential.

Using an oscilloscope, the driving waveforms and a light-emission waveform L are observed. In a period in which the ramp waveform is applied, a time at which the light-emission waveform L is first output is detected as a discharge start point ($t_{start}$ in FIG. 25B). At $t_{start}$, the driving voltages of the display electrode X, the scanning electrode Y, and the address electrode A are read to determine the voltage between the X and Y electrodes and the voltage between the A and Y electrodes. Specifically, the voltage between the X and Y electrodes and the voltage between the A and Y electrodes corresponding to $V_{start}$ are determined. Referring to FIG. 25B, the voltage between the X and Y electrodes is $-V_{start}$, and the voltage between the A and Y electrodes is $V_{off}-V_{start}$. The measured values ($-V_{start}$ and $V_{off}-V_{start}$) are plotted in a coordinate plane having the XY voltage as the abscissa and the AY voltage as the ordinate.

Since the wall voltage in the cell is zero as a result of resetting using the self-erasing discharge, the voltage applied to each electrode is equivalent to the cell voltage. Therefore, the plotted points are concentrated to a single point on the "$V_t$ closed curve". Similar measurement is performed while changing the offset voltage $V_{off}$ to measure part of the "$V_t$ closed curve" (one side of the hexagon shown in FIG. 7B).

Similar measurement is performed while changing the combination of the electrodes to which the ramp wave, offset pulse, and ground potential are applied, thereby measuring the entire "$V_t$ closed curve".

Figure 7B:
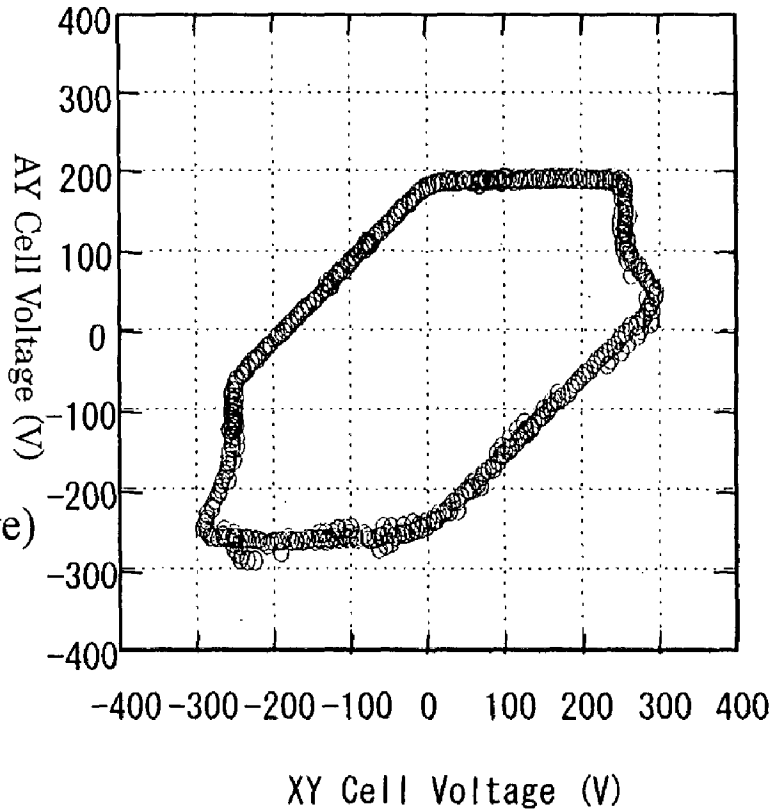
FIG. 7B illustrates a $V_t$ closed curve.
Figure 7A:
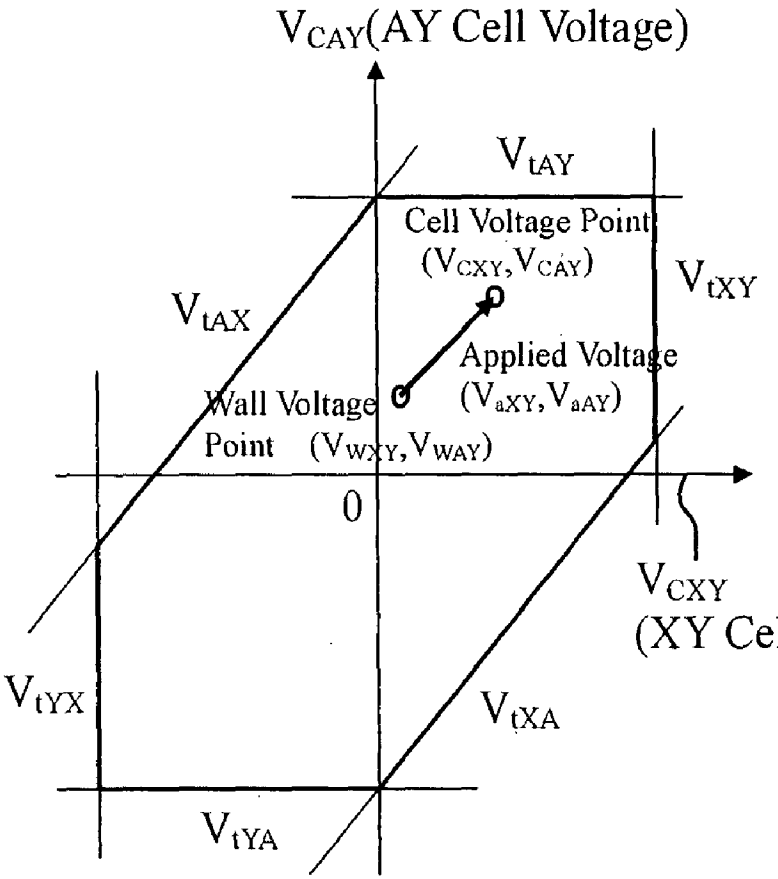
FIG. 7A illustrates a cell voltage plane.
Figure 8B:
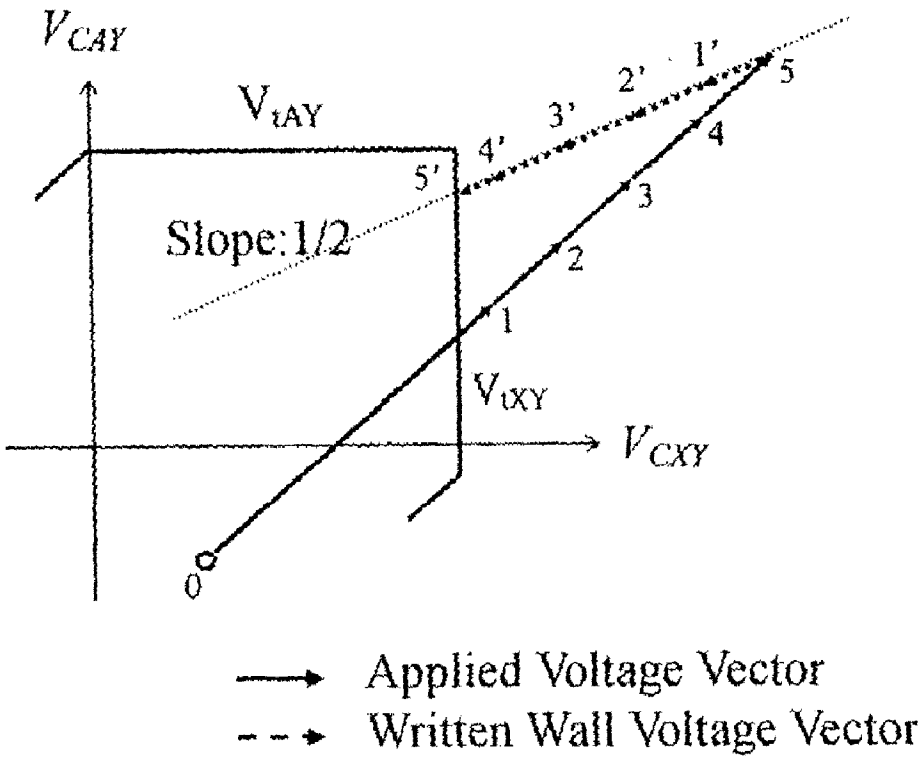
FIGS. 8A and 8B illustrate a method of analyzing the movement of the wall voltage upon application of a ramp voltage.
Figure 8A:
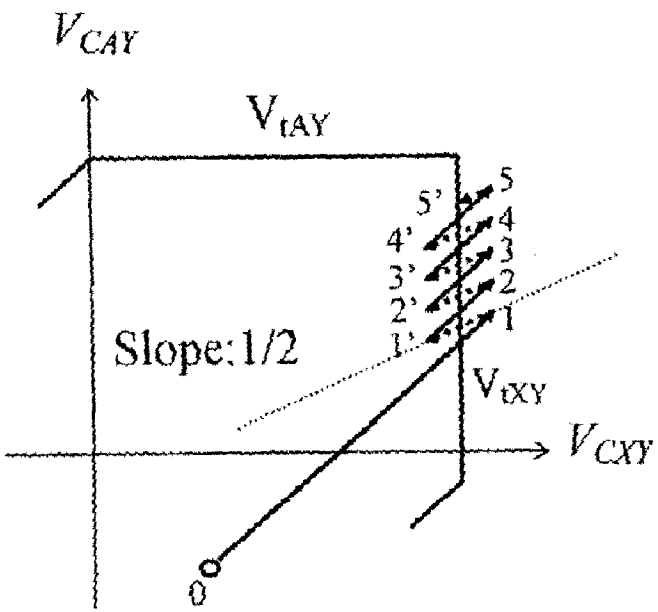
Figure 9:
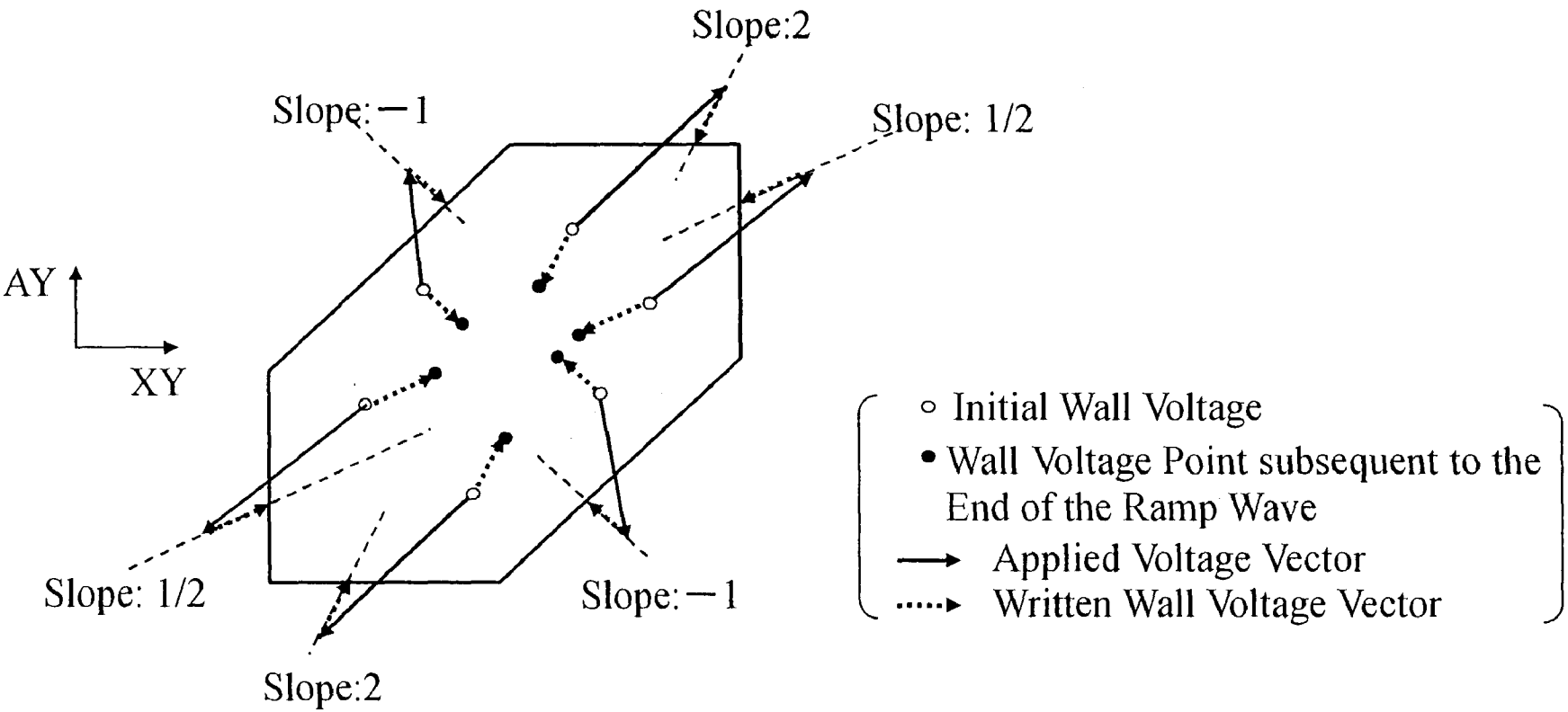
FIG. 9 illustrates directions in which the wall voltage moves due to a ramp-caused discharge.
Figures 10A, 10B:
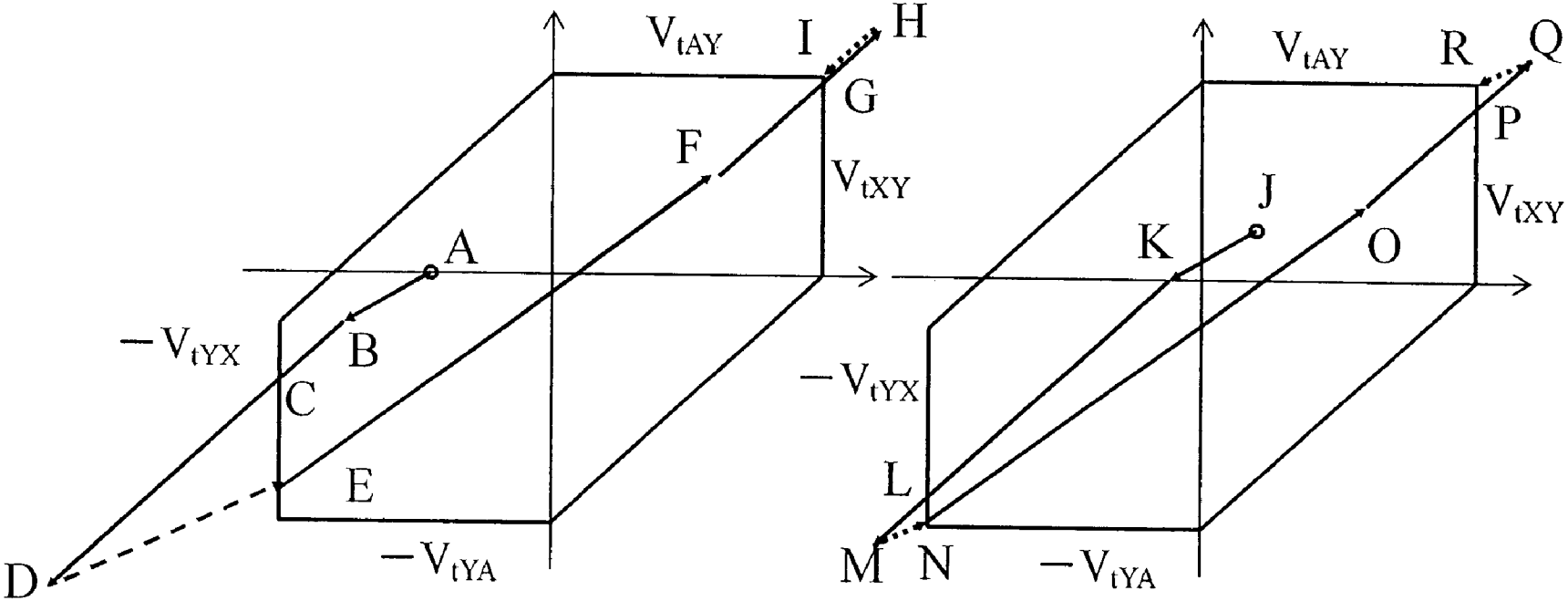
FIG. 10 illustrates the operation analysis of the resetting using the cell voltage plane.
Figure 11:
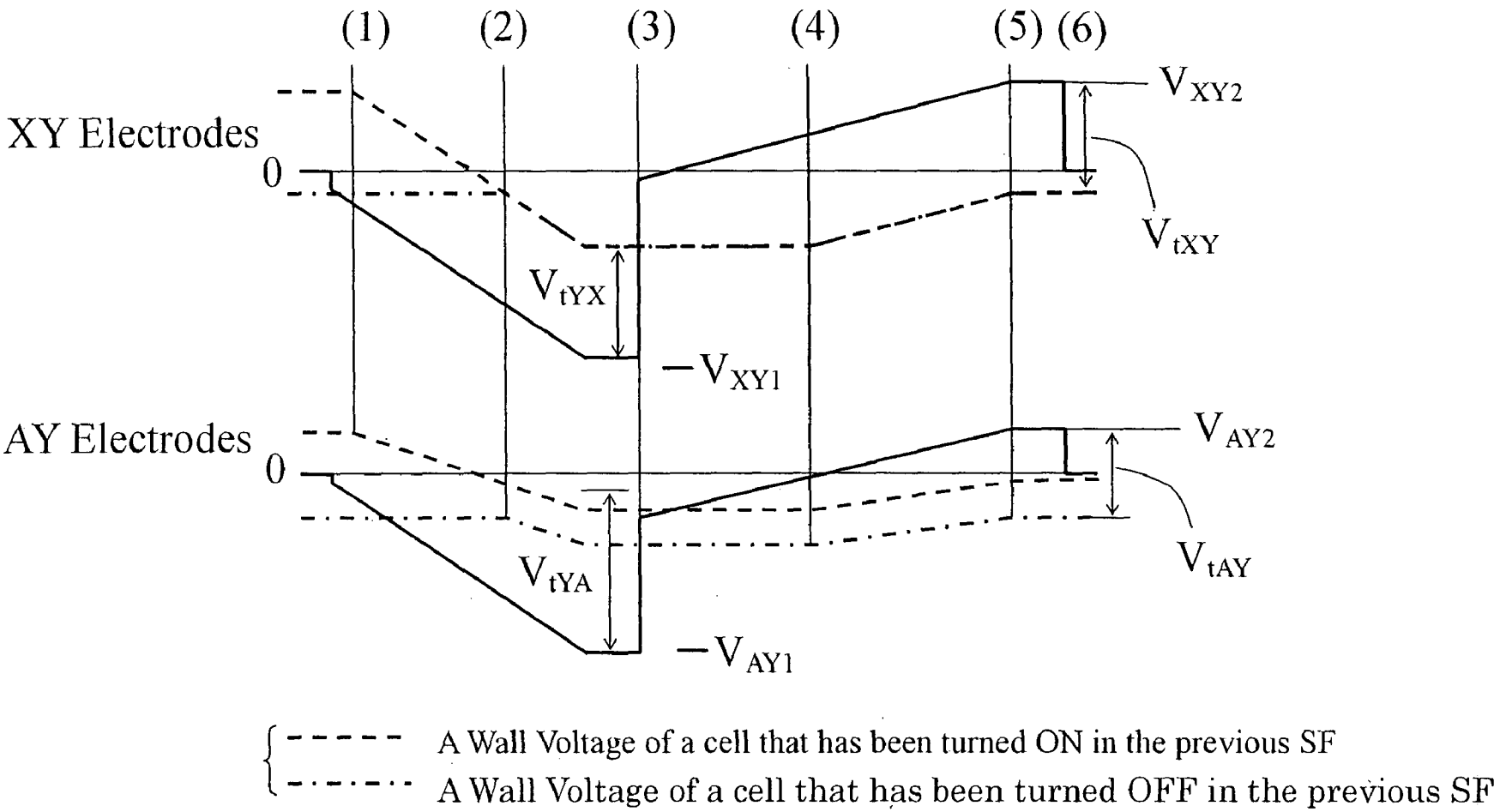
FIG. 11 illustrates the behaviors of the wall voltages upon application of the resetting waveforms (in the case of the insufficient resetting)

As a result, for example, measured data such as that shown in FIG. 7B is obtained. By associating the measured data with six types of threshold voltages $V_{tXY}$, $V_{tYX}$, $V_{tAY}$, $V_{tYA}$, $V_{tAX}$, and $V_{tXA}$ shown in FIG. 7A, the corresponding discharge starting threshold voltages are determined.

Figure 1:
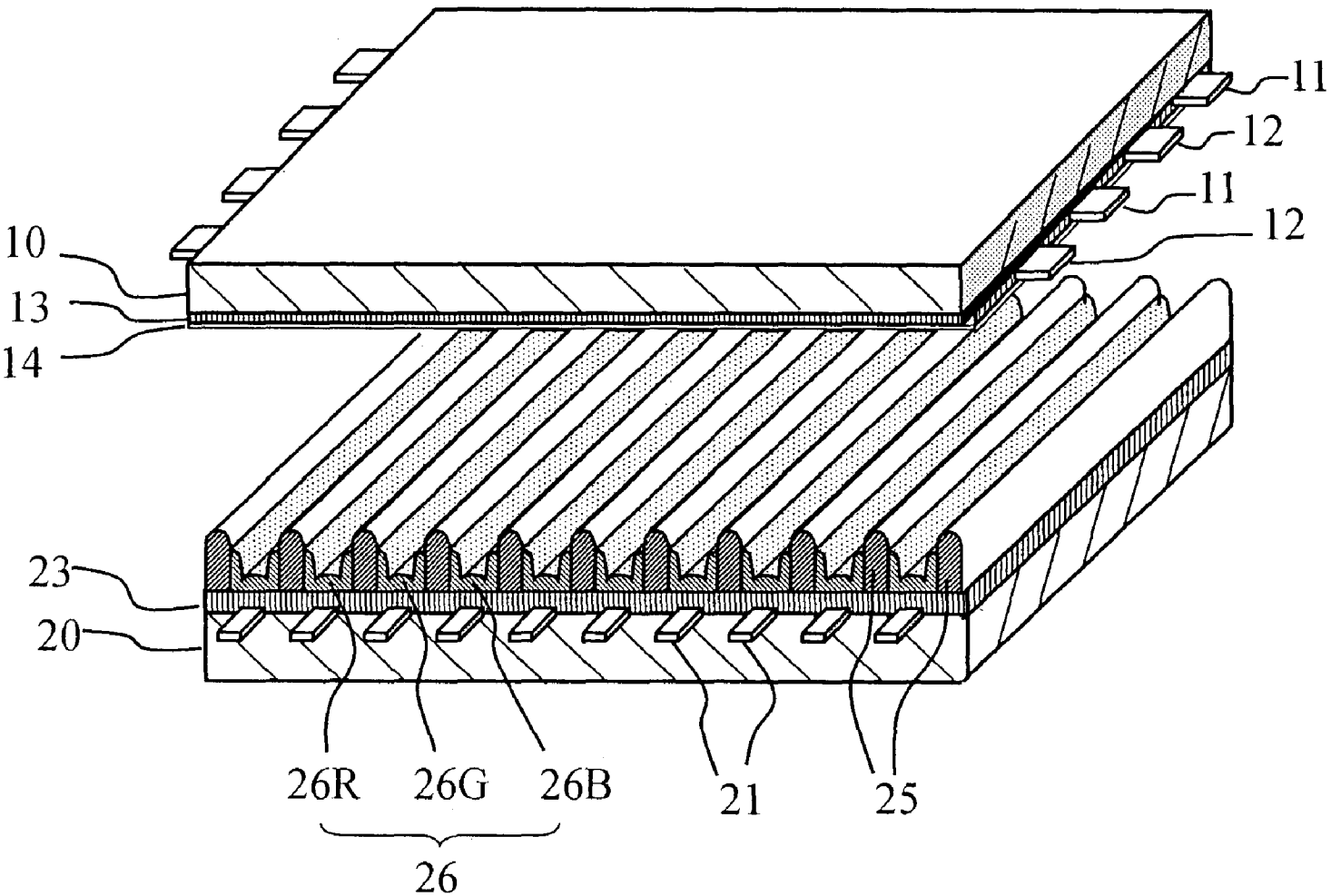
FIG. 1 is an exploded perspective view of the structure of a PDP.
Figure 2:
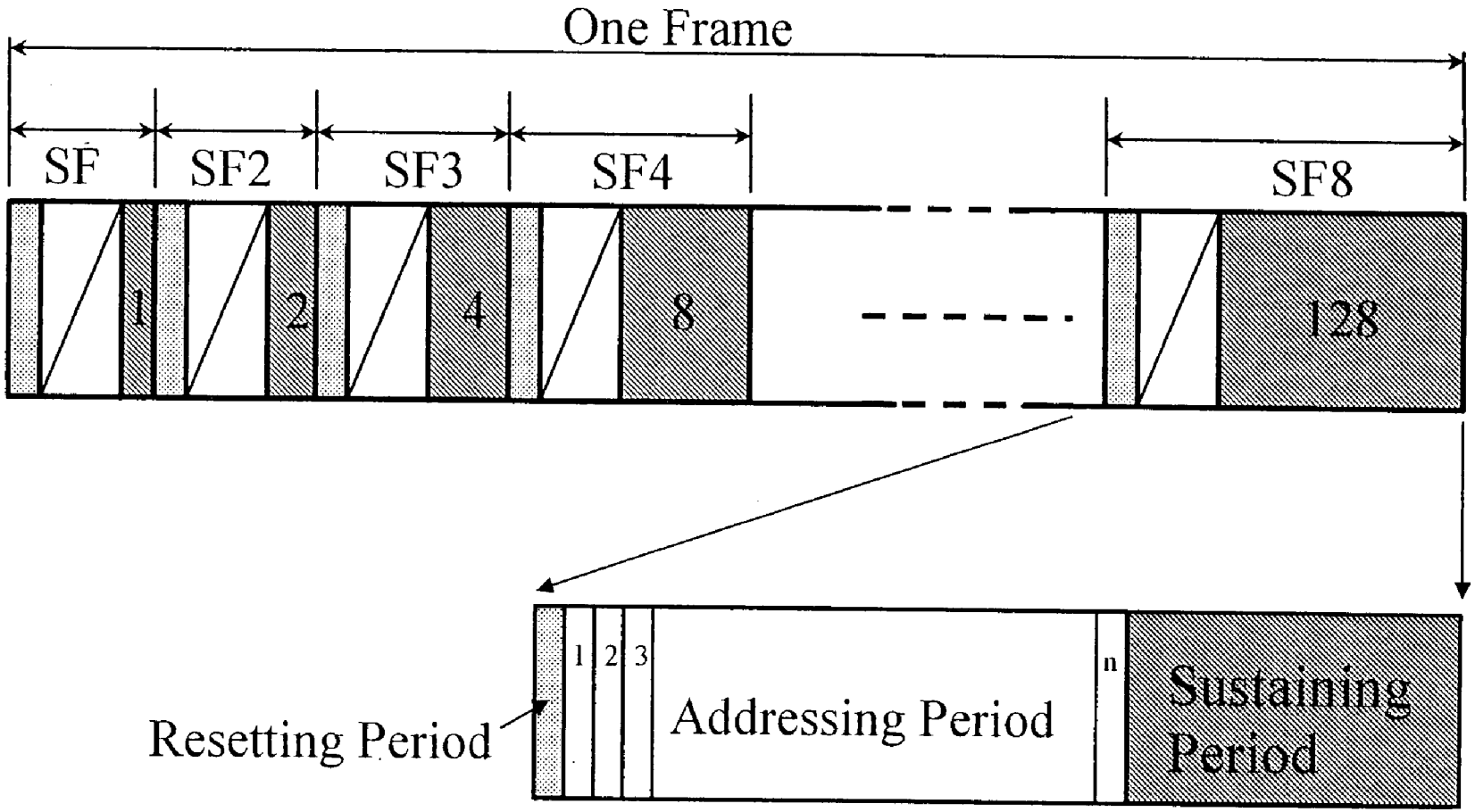
FIG. 2 illustrates PDP grayscale control.
Figure 3:
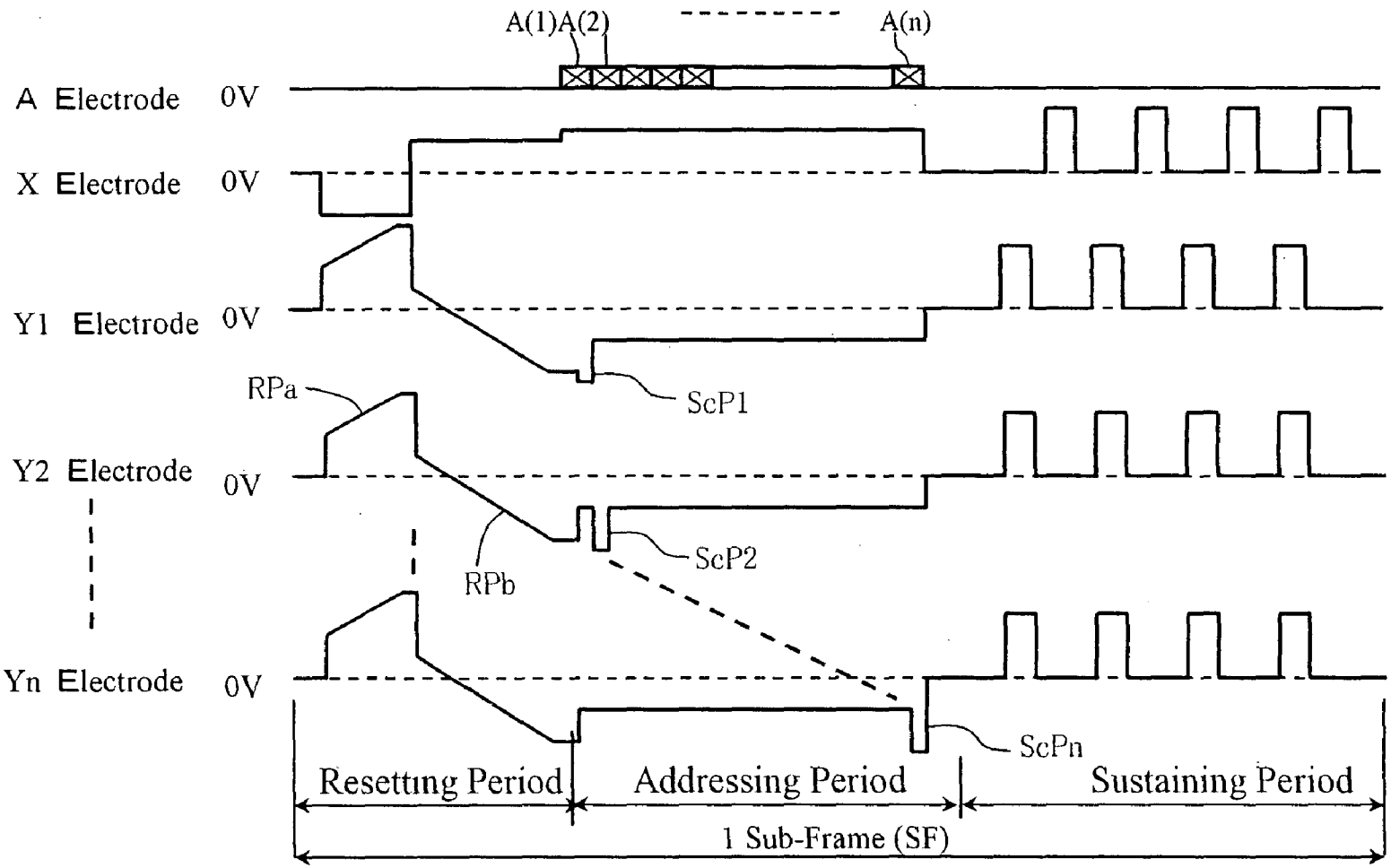
FIG. 3 illustrates driving waveforms applied to the PDP.
Figure 4:
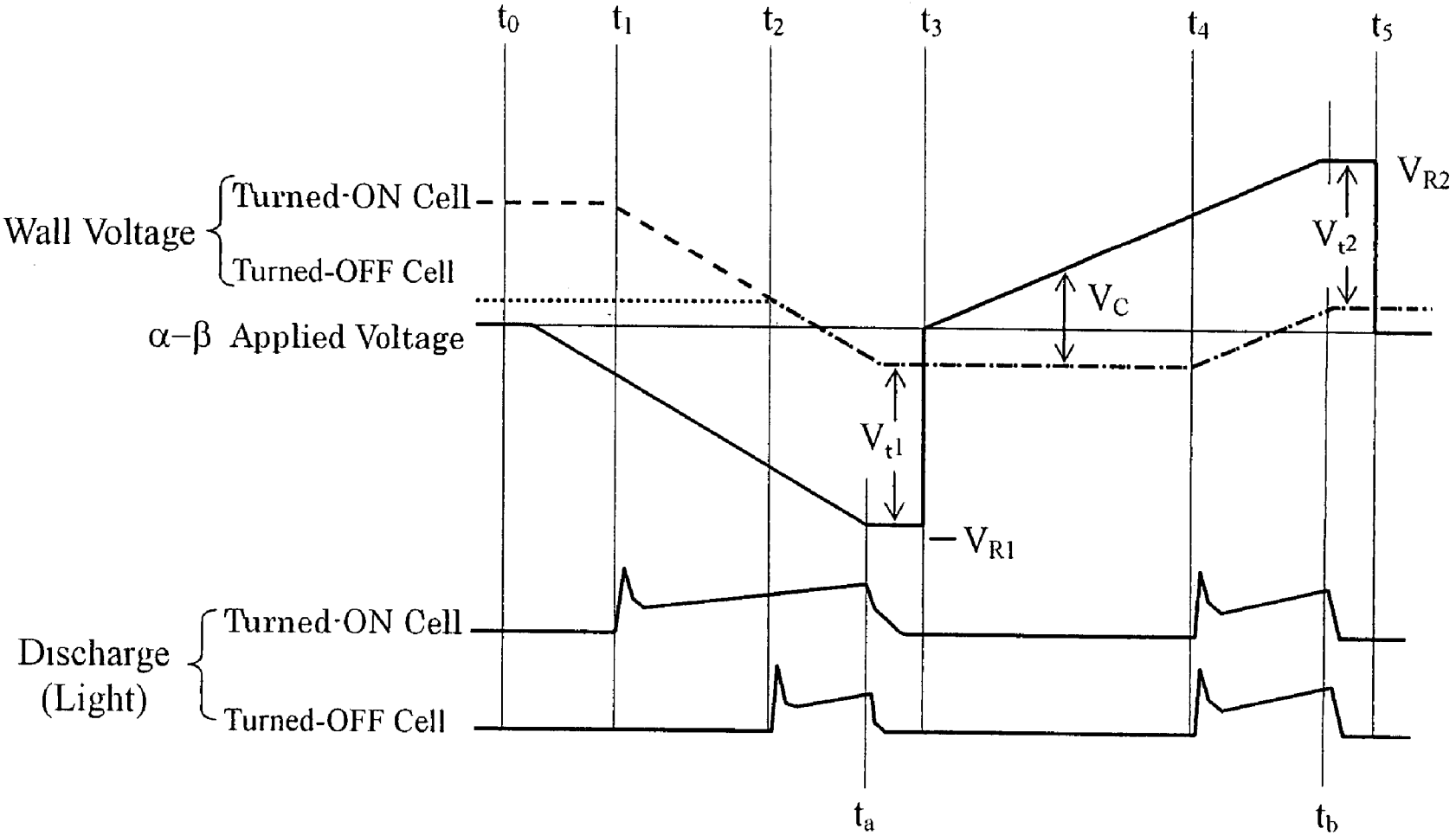
FIG. 4 illustrates the resetting operation principle.
Figure 5B:
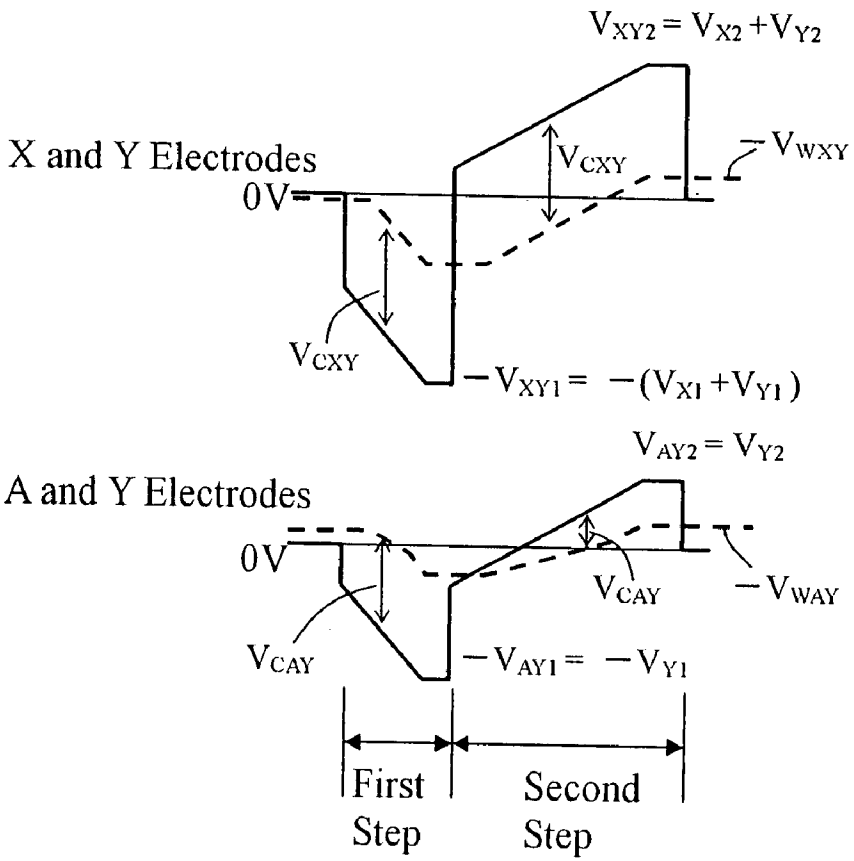
FIGS. 5A and 5B illustrate the driving waveforms and the operation of a discharge cell in a resetting period.
Figure 5A:
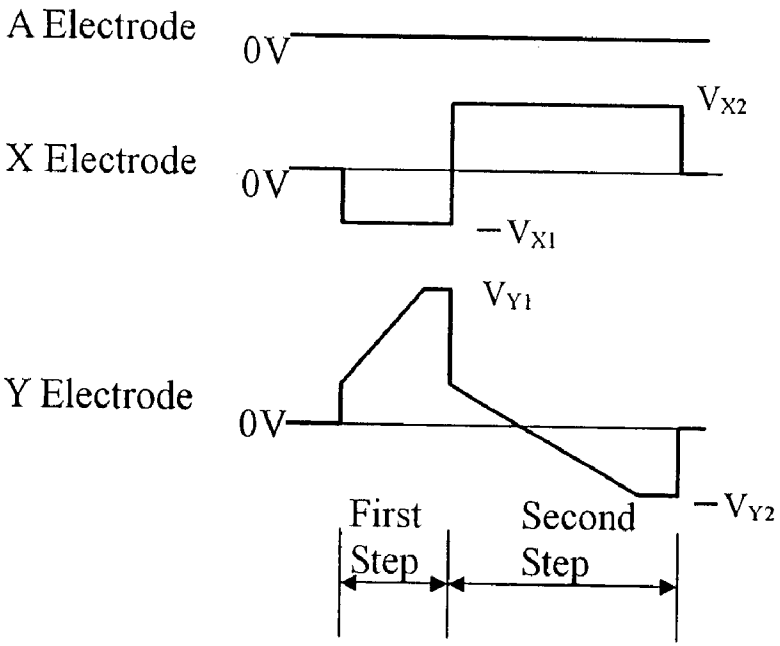
Figure 6:
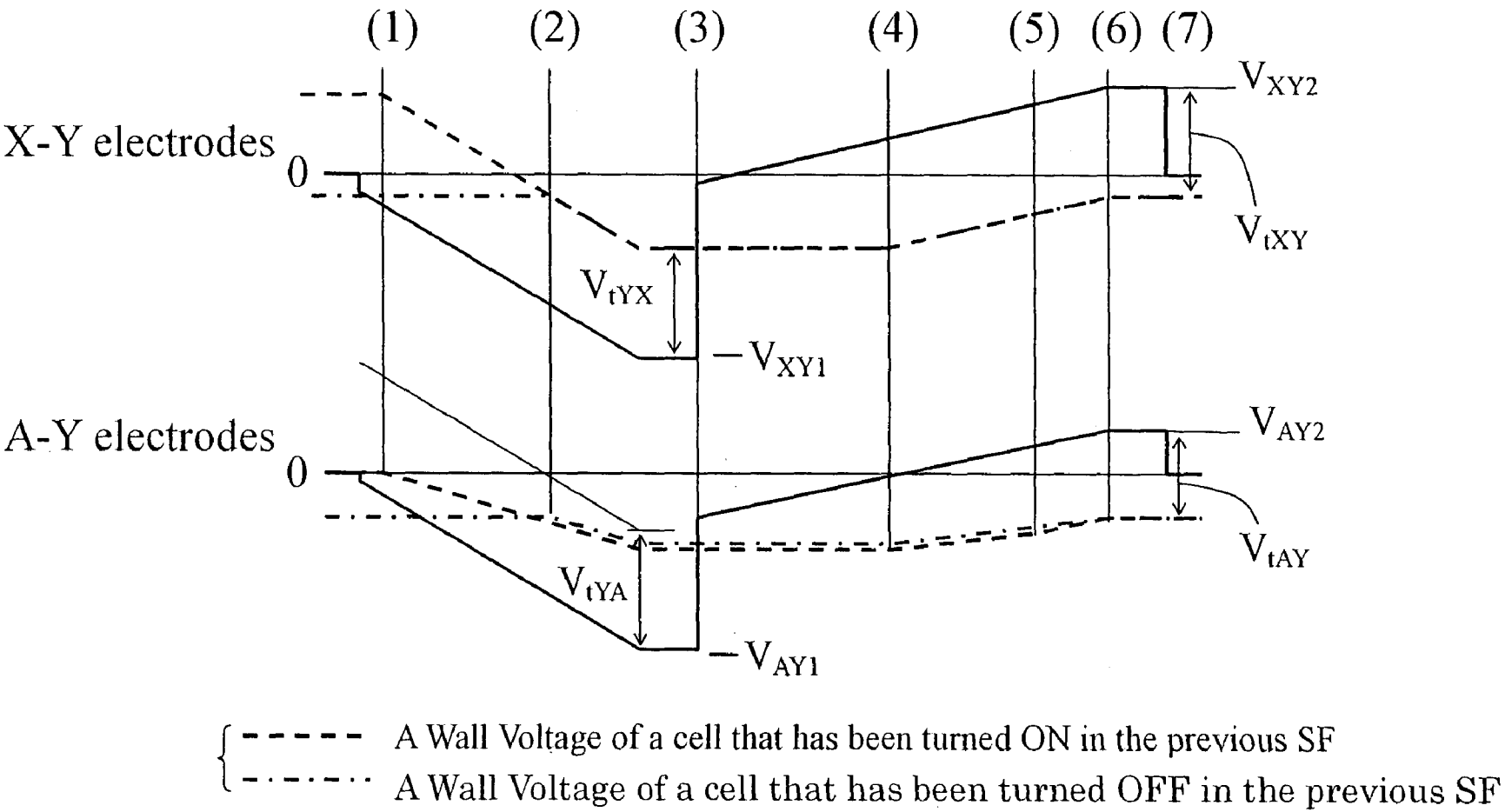
FIG. 6 illustrates the behaviors of wall voltages upon application of resetting waveforms (in the case of the satisfactory resetting)

The first to ninth embodiments described above are embodiments of a PDP of the type shown in FIG. 1 (which is widely used in the PDP industry and which initiates a sustaining discharge between each of the display electrodes X and the corresponding scanning electrode Y adjacent thereto on "one side") and a driving method therefore. However, the present invention is not limited to this type of PDP. In addition to this type of PDP, the present invention according to the first to ninth embodiments is similarly applicable to a PDP of the type described in Japanese Unexamined Patent Application Publication No. 9160525 (which is generally referred to as ALIS (Alternate Lighting of Surfaces) and which initiates a sustaining discharge between each of the display electrodes X and the corresponding scanning electrodes Y adjacent thereto on "both sides") and a driving method therefore.

By using a PDP driving method in accordance with the invention, satisfactory resetting of the PDP is made possible regardless of the state of a cell (turned-ON or turned-OFF) in the previous SF. Also, the voltage condition for the resetting driving waveform is eased. As a result, display problems caused by resetting can be solved, and the performance of the PDP is improved.

What is claimed is:

1. A method of driving a plasma display panel including a plurality of X electrodes and a plurality of Y electrodes arranged in alternating, spaced relationship on a base plate, and a plurality of address electrodes spaced from and crossing the X and Y electrodes, comprising:

generating initializing discharges with at least one ramp waveform voltage applied between the X electrodes and Y electrodes during an initializing period;

generating addressing discharges between the Y electrodes and the address electrodes during an addressing period; and generating sustaining discharges between the X electrodes and Y electrodes during a sustaining period, said initializing period, said addressing period and said sustaining period cyclically recurring, wherein the voltage of a driving waveform for each electrode satisfies the following relational expression:

$$2V_{tAY}-V_{tXY}\leqq 2V_{AY}-V_{XY}-2V_{aoff},$$

wherein $V_{tAY}$ denotes a discharge starting threshold voltage between the address electrodes and the Y electrodes, and $V_{tXY}$ denotes a discharge starting threshold voltage between the X electrodes and the Y electrodes, when the V electrodes serve as cathodes, wherein $V_{AY}$ denotes a voltage applied between the address electrodes and the Y electrodes, and $V_{XY}$ denotes a voltage applied between the X electrodes and the Y electrodes, at the trailing edge of the ramp waveform at the end of the initializing period, and wherein $V_{aoff}$ denotes an offset voltage of the voltage applied between the address electrodes and the Y electrodes at the end of the sustaining period.

2. The method of driving a plasma display panel according to claim 1, wherein, when a driving waveform having two or more types of offset voltages $V_{aoff}$ is used in the sustaining period, the plasma display panel is driven by setting the voltage of the driving waveform so as to satisfy the relational expression at the end of the sustaining period.

3. The method of driving a plasma display panel according to claim 1, wherein, when a driving waveform having an alternating voltage with two or more types of amplitudes is used as a driving waveform to be applied between the address electrodes and the Y electrodes in the sustaining period, the plasma display panel is driven by setting the voltage of the driving waveform so as to satisfy the relational expression at the end of the sustaining period.

4. The method of driving a plasma display panel according to claim 1, wherein, when the address electrodes serve as a cathode, $V_{tXY}$ denotes a discharge starting threshold voltage between the X electrodes and the address electrodes, and $V_{tYA}$ denotes a discharge starting threshold voltage between the Y eleofrodes and the address electrodes, when the X electrodes serve as a cathode, $V_{tAX}$ denotes a discharge starting threshold voltage between the address electrodes and the X electrodes, and $V_{tYX}$ denotes a discharge starting threshold voltage between the V electrodes and the X electrodes, and the plasma display panel satisfies the following relational expression:

$$V_{tAY}+V_{tXA}-V_{tXY}>0 \text{ or}$$

$$V_{tYA}+V_{tAX}-V_{tYX}>0.$$

5. A method of driving a plasma display panel including a plurality of X electrodes and a plurality of Y electrodes arranged in alternating, spaced relationship on a base plate and a plurality of address electrodes spaced from and crossing the X and Y electrodes, comprising:

generating initializing discharges with at least one ramp waveform voltage applied between the X electrodes and Y electrodes during an initializing period;

generating addressing discharges between the Y electrodes and the address electrodes during an addressing period; and generating sustaining discharges between the X electrodes and the Y electrodes during a sustaining period, said initializing period, said addressing period and said sustaining period cyclically recurring, wherein the voltage of a driving waveform for each electrode satisfies the following relational expression:

$$2V_{tAY}-V_{tXY}\leqq 2V_{AY}-V_{XY}-2V_{aoff}$$

wherein $V_{tAY}$ denotes a discharge starting threshold voltage between the address electrodes and the Y electrodes, and $V_{tXV}$ denotes a discharge starting threshold voltage between the X electrodes and the Y electrodes when the Y electrodes serve as cathodes, wherein $V_{AY}$ denotes a voltage applied between the address electrodes and the Y electrodes, and $V_{XY}$ denotes a voltage applied between the X electrodes and the Y electrodes at the trailing edge of the ramp waveform at the end of the initializing period, wherein $V_{aoff}$ denotes an offset voltage of the voltage applied between the address electrodes and the Y electrodes at the end of sustaining period, and wherein during the at least one ramp waveform voltage applied to the Y electrode during an initializing period, a voltage opposite to the ramp waveform, voltage is applied on the X electrode and which is not applied to the ramp waveform.

* * * * *

UNITED STATES PATENT AND TRADEMARK OFFICE

CERTIFICATE OF CORRECTION

PATENT NO. : 7,109,662 B2 
APPLICATION NO. : 10/634830
DATED : September 19, 2006
INVENTOR(S) : Koichi Sakita It is certified that error appears in the above-identified patent and that said Letters Patent is hereby corrected as shown below:

Title Page, Column 2 (Abstract), Line 15, change " "2 $V_{tAY}$-$V_{tXY}$>2$V_{AY}$" to --2 $V_{tAY}$-$V_{tXY}$≤2 $V_{AY}$--.

Column 25, Line 11, change "V" to --Y--.

Column 25, Line 39, change "eleofrodes" to --electrodes--.

Column 25, Line 44, change "V" to --Y--.

Column 26, Line 24, after"2$V_{tAY}$-$V_{tXY}$≤2$V_{AY}$-$V_{XY}$-2$V_{aoff}$" insert --,--.

Column 26, Line 40, change "waveform," to --waveform--.

Signed and Sealed this

Tenth Day of April, 2007

JON W. DUDAS
*Director of the United States Patent and Trademark Office*